US005372281A

United States Patent [19]

Palmer et al.

[11] Patent Number: 5,372,281

[45] Date of Patent: Dec. 13, 1994

[54] DISPOSABLE TRAY SUMP FOAMER, ASSEMBLY AND METHODS

[75] Inventors: Darrel Palmer; Robert P. Cook, both of Sandy, Utah

[73] Assignee: Ballard Medical Products, Draper, Utah

[21] Appl. No.: 135,112

[22] Filed: Oct. 12, 1993

Related U.S. Application Data

[62] Division of Ser. No. 963,152, Oct. 19, 1992, Pat. No. 5,339,988.

[51] Int. Cl.[5] ..... B67D 5/00

[52] U.S. Cl. ..... 222/1; 222/82; 222/180; 222/189; 222/209; 222/325; 222/402

[58] Field of Search ..... 222/1, 80, 81, 82, 156, 222/180, 189, 190, 209, 325, 401, 402, 541

[56] References Cited

U.S. PATENT DOCUMENTS

| | | | |
|---|---|---|---|
| Re. 33,564 | 4/1991 | Ford, Jr. | 222/209 |
| 218,164 | 8/1879 | Corey . | |
| 248,983 | 11/1881 | Beall . | |
| 289,585 | 12/1883 | Veber . | |
| 296,435 | 4/1884 | Murdock . | |
| 301,767 | 7/1884 | Stark . | |
| 431,592 | 8/1890 | Kinn . | |
| 439,565 | 10/1890 | Safford . | |
| 1,140,301 | 5/1915 | De Vilbiss | 239/368 |
| 1,141,721 | 6/1915 | Mastin | 239/353 |
| 1,145,029 | 7/1915 | Munro | 239/368 |
| 1,278,284 | 9/1918 | Alexander | 222/209 |
| 1,281,674 | 10/1918 | Seweryn | 239/371 |
| 1,457,895 | 6/1923 | Campanella | 239/343 X |
| 1,488,125 | 3/1924 | Kline | 222/394 |
| 1,537,552 | 5/1925 | Rotunno | 222/190 X |
| 1,715,335 | 5/1929 | Cocks . | |
| 1,792,513 | 2/1931 | Soreny | 222/173 |
| 1,866,285 | 7/1932 | Albertine | 222/189 X |
| 1,893,562 | 1/1933 | Paasche | 239/354 X |
| 1,896,624 | 2/1933 | Hollands | 222/190 |
| 1,907,086 | 5/1933 | Nason | 222/394 X |
| 1,939,981 | 12/1933 | Hillyard | 221/94 |
| 1,983,627 | 12/1934 | Madsen | 299/89 |
| 1,986,444 | 1/1935 | McIntosh | 299/89 |
| 1,995,215 | 3/1935 | Mehlsen | 299/83 |
| 2,103,687 | 12/1937 | McKenney | 221/94 |
| 2,153,156 | 4/1939 | Pollnow | 222/94 |
| 2,154,393 | 4/1939 | Bates | 221/77 |
| 2,213,846 | 9/1940 | Meyer | 299/88 |
| 2,275,051 | 3/1942 | Maloney | 221/85 |
| 2,275,972 | 3/1942 | Maloney | 221/85 |
| 2,318,769 | 5/1943 | Freeman et al. | 29/157 |
| 2,319,244 | 5/1943 | Lo Cascio et al. | 290/83 |

(List continued on next page.)

FOREIGN PATENT DOCUMENTS 554133 1/1957 Belgium .

(List continued on next page.)

OTHER PUBLICATIONS

Ballard Medical Products Foam Care Brochure, date unknown.

*Primary Examiner*—David M. Mitchell
*Assistant Examiner*—Joseph A. Kaufman
*Attorney, Agent, or Firm*—Lynn G. Foster

[57] ABSTRACT

A biological agent growth-limiting and cross contamination suppressing foaming assembly. The foaming assembly comprises a disposable foamable-liquid transport and foaming cartridge and a housing cooperatively used with the cartridge to produce and dispense foam from the cartridge. The cartridge comprises a low-cost package comprising a molded tray which provides cavities for liquid containing chambers, air and liquid communicating channels, and initially sealed but frangible ports and a liquid impervious sheet which covers an open face of the tray to seal otherwise open portions of the chambers, channels and ports. The housing comprises a vertical wall mounting plate, a cartridge accommodating and servicing cover hingeably affixed to the mounting plate, a pump which provides pressurized gas to produce the foam within the cartridge, and sharpened stems or shafts to open the frangible ports. Foamable-liquid is stored within the cartridge during shipment, foamed within the cartridge under pressure from the pump, and dispensed as a foam from a spout which is a part of the tray.

14 Claims, 7 Drawing Sheets

U.S. PATENT DOCUMENTS

| | | | |
|---|---|---|---|
| 2,358,329 | 9/1944 | Houghton | 222/193 |
| 2,365,195 | 12/1944 | Holihan | 299/88 |
| 2,369,721 | 2/1945 | Delzer | 225/3 |
| 2,456,958 | 12/1948 | Kretschmer et al. | 222/179 |
| 2,465,274 | 3/1949 | Rudd | 299/88 |
| 2,492,309 | 12/1949 | Miller | 222/195 |
| 2,509,291 | 5/1950 | Engstrum | 299/88 |
| 2,514,751 | 7/1950 | Engstrum | 299/88 |
| 2,577,321 | 12/1951 | Filger | 122/173 |
| 2,616,095 | 11/1952 | Stuckey | 4/166 |
| 2,652,952 | 9/1953 | Mowbray | 222/180 |
| 2,665,825 | 1/1954 | Poitras et al. | 222/209 |
| 2,680,010 | 6/1954 | Dubay | 261/124 |
| 2,729,505 | 1/1956 | Harvey | 299/90 |
| 2,738,105 | 3/1956 | Wolfer | 222/189 |
| 2,743,038 | 4/1956 | Ferries | 222/95 |
| 2,751,124 | 6/1956 | Jones | 222/179 |
| 2,752,199 | 6/1956 | Newell | 299/90 |
| 2,812,716 | 11/1957 | Gray | 103/37 |
| 2,818,998 | 1/1958 | Jones | 222/179 |
| 2,920,795 | 1/1960 | Piker | 222/131 |
| 2,980,342 | 4/1961 | Armour | 239/327 |
| 2,988,754 | 6/1961 | Misson | 4/182 |
| 3,010,613 | 11/1961 | Stossel | 222/190 |
| 3,012,695 | 12/1961 | Lerner | 222/129 |
| 3,090,528 | 5/1963 | Ellis | 222/179 |
| 3,124,275 | 3/1964 | Lake | 222/450 X |
| 3,132,807 | 5/1964 | Nadai | 239/327 |
| 3,168,968 | 2/1965 | Krakowsky | 222/212 |
| 3,197,081 | 7/1965 | Midworth | 222/179 |
| 3,203,597 | 8/1965 | Birch | 222/179 |
| 3,205,889 | 9/1965 | Alder et al. | 222/541 X |
| 3,229,854 | 2/1966 | Turnquist | 222/450 X |
| 3,233,787 | 2/1966 | Ross | 222/179 |
| 3,257,046 | 6/1966 | Kasson | 222/490 |
| 3,269,389 | 8/1966 | Meurer et al. | 128/198 |
| 3,294,289 | 12/1966 | Bayne et al. | 222/95 |
| 3,308,993 | 3/1967 | Bruno | 222/146 |
| 3,319,835 | 5/1967 | Ensign et al. | 222/180 |
| 3,323,689 | 6/1967 | Elmore | 222/385 |
| 3,346,146 | 10/1967 | Thompson | 222/189 |
| 3,361,304 | 1/1968 | Thompson | 222/189 |
| 3,389,836 | 6/1968 | Wakeman | 222/189 |
| 3,422,993 | 1/1969 | Bohem et al. | 222/190 |
| 3,428,222 | 2/1969 | Wright | 222/187 |
| 3,456,847 | 7/1969 | Scott | 222/95 |
| 3,471,064 | 10/1969 | Micallef | 222/211 |
| 3,474,936 | 10/1969 | McDonnell | 222/211 |
| 3,521,792 | 7/1970 | Davidson | 222/136 |
| 3,531,021 | 9/1970 | Bassett | 222/81 |
| 3,551,076 | 12/1970 | Wilson | 417/385 |
| 3,572,590 | 3/1971 | Malone | 239/327 |
| 3,580,510 | 5/1971 | Batlas | 239/327 |
| 3,581,957 | 6/1971 | McCray | 222/505 |
| 3,606,963 | 9/1971 | Marand | 222/132 |
| 3,618,846 | 11/1971 | Poll | 228/52 |
| 3,622,049 | 11/1971 | Thompson | 222/190 |
| 3,628,700 | 12/1971 | Dodoghue | 222/207 |
| 3,640,470 | 2/1972 | Susuki et al. | 239/333 |
| 3,647,119 | 3/1972 | Samuelson | 222/402.18 |
| 3,651,990 | 3/1972 | Cernei | 222/94 |
| 3,706,400 | 12/1972 | Schindler | 222/95 |
| 3,709,437 | 1/1973 | Wright | 239/343 |
| 3,790,034 | 2/1974 | Horvath | 222/153 |
| 3,820,689 | 6/1974 | Cocita | 222/207 |
| 3,824,002 | 7/1974 | Beard | 350/160 |
| 3,937,364 | 2/1976 | Wright | 222/190 |
| 3,938,514 | 2/1976 | Boucher | 128/232 |
| 3,945,534 | 3/1976 | Ady | 222/105 |
| 3,952,924 | 4/1976 | Benson | 222/181 |
| 3,960,745 | 6/1976 | Billany et al. | 252/106 |
| 3,973,701 | 11/1976 | Gardner | 222/190 |
| 3,985,271 | 10/1976 | Gardner | 222/190 |
| 4,018,363 | 4/1977 | Cassia | 222/80 |
| 4,018,364 | 4/1977 | Wright | 222/190 |
| 4,022,351 | 5/1977 | Wright | 222/145 |
| 4,024,992 | 5/1977 | Schmid | 222/211 |
| 4,027,789 | 6/1977 | Dickey | 222/190 |
| 4,044,923 | 8/1977 | Gardner | 222/190 |
| 4,046,289 | 9/1977 | Teramishi | 222/146 |

(List continued on next page.)

FOREIGN PATENT DOCUMENTS

| | | |
|---|---|---|
| 229360 | 3/1923 | Canada . |
| 414650 | 8/1943 | Canada . |
| 583961 | 9/1959 | Canada . |
| 669247 | 8/1963 | Canada . |
| 720699 | 11/1965 | Canada . |
| 925836 | 5/1973 | Canada . |
| 961015 | 1/1975 | Canada . |
| 999833 | 11/1976 | Canada . |
| 1029696 | 4/1978 | Canada . |
| 1034096 | 7/1978 | Canada . |
| 1059082 | 7/1979 | Canada . |
| 1063983 | 10/1979 | Canada . |
| 1090748 | 12/1980 | Canada . |
| 1114786 | 12/1981 | Canada . |

(List continued on next page.)

U.S. PATENT DOCUMENTS

| | | | |
|---|---|---|---|
| 4,245,788 | 1/1981 | Wright | 239/327 |
| 4,258,865 | 3/1981 | Vahl et al. | 222/213 |
| 4,274,594 | 6/1981 | Ito | 239/327 |
| 4,316,555 | 2/1982 | Smith | 222/83.5 |
| 4,327,782 | 5/1982 | McKibben et al. | 141/26 |
| 4,330,072 | 5/1982 | Mastman | 222/209 |
| 4,349,129 | 9/1982 | Amneus | 222/41 |
| 4,349,131 | 9/1982 | Arabian | 222/135 |
| 4,350,298 | 9/1982 | Tada | 239/333 |
| 4,375,864 | 3/1983 | Savage | 222/81 |
| 4,411,656 | 10/1983 | Cornett, III | 684/212 |
| 4,420,098 | 12/1983 | Bennett | 222/190 |
| 4,429,834 | 2/1984 | Ito | 239/327 |
| 4,432,496 | 2/1984 | Ito | 239/327 |
| 4,456,152 | 6/1984 | Young et al. | 222/309 |
| 4,463,876 | 8/1984 | Swallert | 222/94 |
| 4,474,540 | 10/1984 | Bonastia et al. | 417/63 |
| 4,489,857 | 12/1984 | Batlas | 222/179 |
| 4,509,661 | 4/1985 | Sugizaki et al. | 222/190 |
| 4,516,697 | 5/1985 | Dreps et al. | 222/212 |
| 4,531,659 | 7/1985 | Wright | 222/190 |
| 4,531,660 | 7/1985 | Ford | 222/209 |
| 4,564,127 | 1/1986 | Garabedian et al. | 222/96 |
| 4,596,343 | 6/1986 | Ford, Jr. | 222/190 |
| 4,615,467 | 10/1986 | Grogan et al. | 222/189 |
| 4,640,440 | 2/1987 | Ford, Jr. et al. | 222/190 |
| 4,741,461 | 5/1988 | Williamson et al. | 222/325 X |
| 4,836,422 | 6/1989 | Rosenberg | 222/190 |
| 4,880,161 | 11/1989 | Wright | 239/330 |
| 4,901,925 | 2/1990 | Blake, III | 239/343 |
| 4,957,218 | 9/1990 | Ford, Jr. | 222/1 |
| 5,114,033 | 5/1992 | Golias et al. | 222/82 |
| 5,277,920 | 1/1994 | Weaver, Jr. | 222/541 X |
| 4,087,024 | 5/1978 | Martin et al. | 222/211 |
| 4,091,966 | 5/1978 | Laauwe | 222/211 |
| 4,093,124 | 6/1978 | Morane et al. | 239/327 |
| 4,098,434 | 7/1978 | Uhlig | 222/94 |
| 4,111,304 | 9/1978 | Lucas | 222/541 X |
| 4,121,736 | 10/1978 | McGaw, Jr. | 222/94 |
| 4,122,979 | 10/1978 | Laauwe | 222/193 |
| 4,147,278 | 4/1979 | Uhlig | 222/94 |
| 4,147,306 | 4/1979 | Bennett | 239/327 |
| 4,156,505 | 5/1979 | Bennett | 239/327 |
| 4,184,615 | 1/1980 | Wright | 222/190 |
| 4,186,882 | 2/1980 | Szezepanski | 239/327 |
| 4,219,159 | 8/1980 | Wesner | 239/343 |

FOREIGN PATENT DOCUMENTS

| | | |
|---|---|---|
| 1149346 | 7/1983 | Canada . |
| 1152380 | 8/1983 | Canada . |
| 508288 | 1/1920 | France . |
| 605822 | 1/1925 | France . |
| 650120 | 1/1929 | France . |
| 820387 | 11/1937 | France . |
| 855311 | 5/1940 | France . |
| 1467954 | 12/1965 | France . |
| 1418581 | 2/1966 | France . |
| 426000 | 3/1926 | Germany . |
| 590565 | 12/1933 | Germany . |
| 1284200 | 11/1968 | Germany . |
| 2155014 | 6/1972 | Germany . |
| 356651 | 10/1937 | Italy . |
| 638023 | 4/1962 | Italy . |
| 679400 | 12/1964 | Italy . |
| 319068 | 1/1957 | Switzerland . |
| 457308 | 7/1968 | Switzerland . |
| 7723 | of 1895 | United Kingdom . |
| 3615 | of 1913 | United Kingdom . |
| 213103 | 3/1923 | United Kingdom . |
| 209724 | 11/1925 | United Kingdom . |
| 350091 | 6/1931 | United Kingdom . |
| 539418 | 9/1941 | United Kingdom . |
| 655442 | 7/1951 | United Kingdom . |
| 922347 | 3/1963 | United Kingdom . |
| 953937 | 4/1964 | United Kingdom . |
| 1180376 | 2/1970 | United Kingdom . |
| 1213111 | 11/1970 | United Kingdom . |
| 1298553 | 12/1972 | United Kingdom . |
| 2038954 | 6/1980 | United Kingdom . |
| 8909095 | 10/1989 | WIPO . |

DISPOSABLE TRAY SUMP FOAMER, ASSEMBLY AND METHODS

CONTINUITY

This application is a division of U.S. patent application Ser. No. 07/963,152, filed Oct. 19, 1992 now U.S. Pat. No. 5,339,988.

FIELD OF THE INVENTION

This invention relates generally to foam dispensing devices and particularly to self-contained disposable foamers which comprise a relatively large foamable-liquid storage reservoir and a relatively small foam generating pump chamber and which are capable of eliminating carry-over contamination and long term biological agent growth within the foamers by disposing of all liquid contaminated parts each time a spent foamable-liquid container is replaced.

BACKGROUND AND DESCRIPTION OF RELATED ART

Several non-aerosol foaming devices are known which are essentially hand-held squeeze bottles of relatively small capacity. Such squeeze bottles, as exemplified by U.S. Pat. No. 3,709,437 and U.S. Pat. No. 3,937,364, work well for their intended purpose but are not readily adapted for use with large containers which are considerably more economical to use.

A foam dispenser device, disclosed in U.S. Pat. No. Re. 33,564 discloses method and apparatus for producing foam with containers of greater capacity. The device provides a means of using large capacity containers for the production of high quality foam by utilizing an inner auxiliary container which is replenished with a foamable-liquid supply from a larger container. In the past, it has been a practice due to the relatively high cost of replacement of such foam producing apparatus, to resupply foamable-liquid to the foam dispensing device by replacing or refilling the larger container. However, such practices have resulted in residues of foamable-liquid being left in foam generating reservoirs and chambers for extended periods of time. Even though anti-biological chemicals are used to discourage growth of biological agents in such liquid refills, cross contamination and evolving development of resistance to such chemicals by some contaminating agents, and resulting in-foamer multiplication of those undesirable biological agents are known. In an environment where it is the express purpose of the foam to destroy all undesirable biological agents, such results of proliferating contamination and cross contamination due to long term use of a foam containing device is highly undesirable.

BRIEF SUMMARY AND OBJECTS OF THE INVENTION

In brief summary, this novel invention alleviates all of the known problems related to cross contamination between lots of foamable-liquid and long term growth of undesirable biological agents due to contamination or development of increased resistance to anti-biological chemicals during long periods of residence in a foamer by providing a non-reusable, foamable-liquid transport and foamer. To be effective in this application, the foamable-liquid disposable transport/foamer must be economically effective from both a production cost and handling aspect. In addition, a housing or foamable-liquid disposable transport/foamer holder, a pump and other apparatus used with the disposable must be equally as economically effective as the disposable transport/foamer.

This invention therefore comprises a foamable-liquid transport and foam producing disposable container or cartridge. The disposable container or cartridge comprises a molded three-dimensional body or tray which, except for one open side, comprises all necessary foamable-liquid containing cavities, storage chambers or reservoirs, fluid and foam flow chambers, cavities or channels, and a foam creating chamber or site molded into the body or tray. A planar member comprising a sheet of liquid impermeable synthetic resinous material is applied and sealed to the open side of the tray to enclose all cavities comprising a relatively large storage reservoir for a quantity of foamable-liquid and a relatively small pump chamber for periodically being charged with foamable-liquid from the relatively large reservoir, the channels comprising both air and liquid passageways or chambers, the foam creating site or cavity, and a foam chamber. In addition, the tray comprises two gas entry ports, each being initially closed by a frangible membrane which is part of the tray mold. For those container or cartridge assembling and filling circumstances where foamable-liquid is added after the impermeable plastic sheet is sealed to the tray, a sealable foamable-liquid fill port is also part of the molded body or tray part. In such a case, a plug is used to close the fill port and seal the disposable container or cartridge after filling. In this manner, a long shelf-life foamable-liquid disposable container or cartridge, which remains totally sealed until use, is provided.

The invention also comprises a housing or holder associated with the disposable container or cartridge. The housing or holder comprises a rear or back plate for mounting the housing to a vertical surface to fix the operative orientation of the disposable cartridge. A cavity defining front housing or front cover of the housing, hingeably attached to the mounting plate, is opened and disposed to receive and maintain the disposable cartridge in the operative orientation when closed.

The front cover comprises a pair of orifices, providing access for a foam dispensing spout which is also molded into the tray and access for a manually operable air pump. As a part of the housing, the pump comprises hollow stems or shafts which are disposed to frange the frangible ports as the disposable cartridge is inserted into the cover. Franging or puncturing the frangible ports breaks the seal and provides access for pressurized gas to be released into the disposable cartridge. The resultant discharge of gas from the pump generates and forces foam through the dispensing spout. As the franging stem or shaft parts are also subject to potential contamination, at least those parts associated with the pump stems and shafts are also replaceable as resterilized parts or inexpensively disposable.

Accordingly, it is a primary object to provide a foam dispensing assembly comprising a low-cost, disposable foamable-liquid transport and foaming cartridge and a housing or holder in which the disposable cartridge is used.

It is another primary object to provide a low-cost disposable foamable-liquid cartridge which is sealed for transport of liquids, the seal being frangibly breakable during installation into the housing prior to use.

It is another primary object to provide a low-cost disposable foamable-liquid cartridge which is a sealed package for transport and storage and which comprises a foam creating site.

It is yet another primary object to provide a low-cost disposable foamable-liquid cartridge comprising an open-faced molded tray which comprises wells for foamable-liquids, frangible inlet ports, an outlet port and spout, a foam creating site, and communicating channels between the ports, wells and foam creating site which is covered and sealed on the face by a single thin liquid impervious sheet of synthetic resinous material.

It is an important object to provide a housing which is facilely mounted to a vertical surface.

It is a principal object to provide a housing in which the cartridge is held during use in a predetermined orientation relative to the vertical surface.

It is another principal object to provide a housing which comprises a cover into which the cartridge is conveniently disposed during installation and use.

It is still another principal object to provide a pump, releasibly affixed to the cover, which is facilely operationally attached to the cartridge during installation.

It is a key object to provide a pump which comprises parts which readily are readily interjected through the frangible parts of the tray during installation of the cartridge.

It is an object to provide a pump which is keyed to be only disposed in a particular orientation relative to the predetermined orientation of the cartridge in the housing.

It is an object to provide a pump which is at least partially disposable or resterilizable such that those parts, which may contact liquids within the cartridge and thereby cross contaminate liquid from one disposable cartridge to liquid in another disposable cartridge, are readily replaced.

It is an object to provide a sealed low-cost, disposable foamable-liquid transport and foaming cartridge having gas containing channels, one of which separates each liquid containing reservoir from contact with the frangible parts of the cartridge and therefore the franging and potentially cross contaminating parts of the pump.

It is an object to provide a low-cost, disposable foamable-liquid transport and foaming cartridge comprising one large volume reservoir which provides an ample long-term-use supply of foamable-liquid and a smaller pump chamber having a volume consistent with producing foam from each unit emission of gas from the manually operated pump.

It is another object to provide a low-cost, one-way valve interposed between the large volume reservoir and smaller volume pump chamber through which the smaller pump chamber is filled and refilled and through which foamable-liquid does not flow from the smaller pump chamber to the large volume reservoir.

It is another object to provide a predetermined orientation of the cartridge within the housing such that foamable-liquid is delivered from the large reservoir to the smaller pump chamber by force of gravity.

It is another object to provide a tray for the cartridge which is molded as a single part.

It is an object to provide a method for making a foamable-liquid transport and foaming cartridge.

It is an object to provide a method for assembling and using a foam dispenser comprising a housing and a disposable cartridge.

It is an object to provide a method for maintaining a biological agent growth-limiting and cross contamination free environment while providing a broad spectrum antiseptic foam from a foam dispensing station throughout the use of a plurality of disposable cartridges at the station.

It is an object to provide a method for filling a disposable cartridge with foamable-liquid.

These and other objects and features of the present invention will be apparent from the detailed description taken with reference to accompanying drawings.

DETAILED DESCRIPTION OF THE ILLUSTRATED EMBODIMENTS

In this description, the term proximal is used to indicate the segment of the device normally closest a user of the device. The term distal refers to the other end. The comparative term superior is a positional reference indicating greater elevation. Inferior indicates lower elevation.

Figures 1, 5, 6:
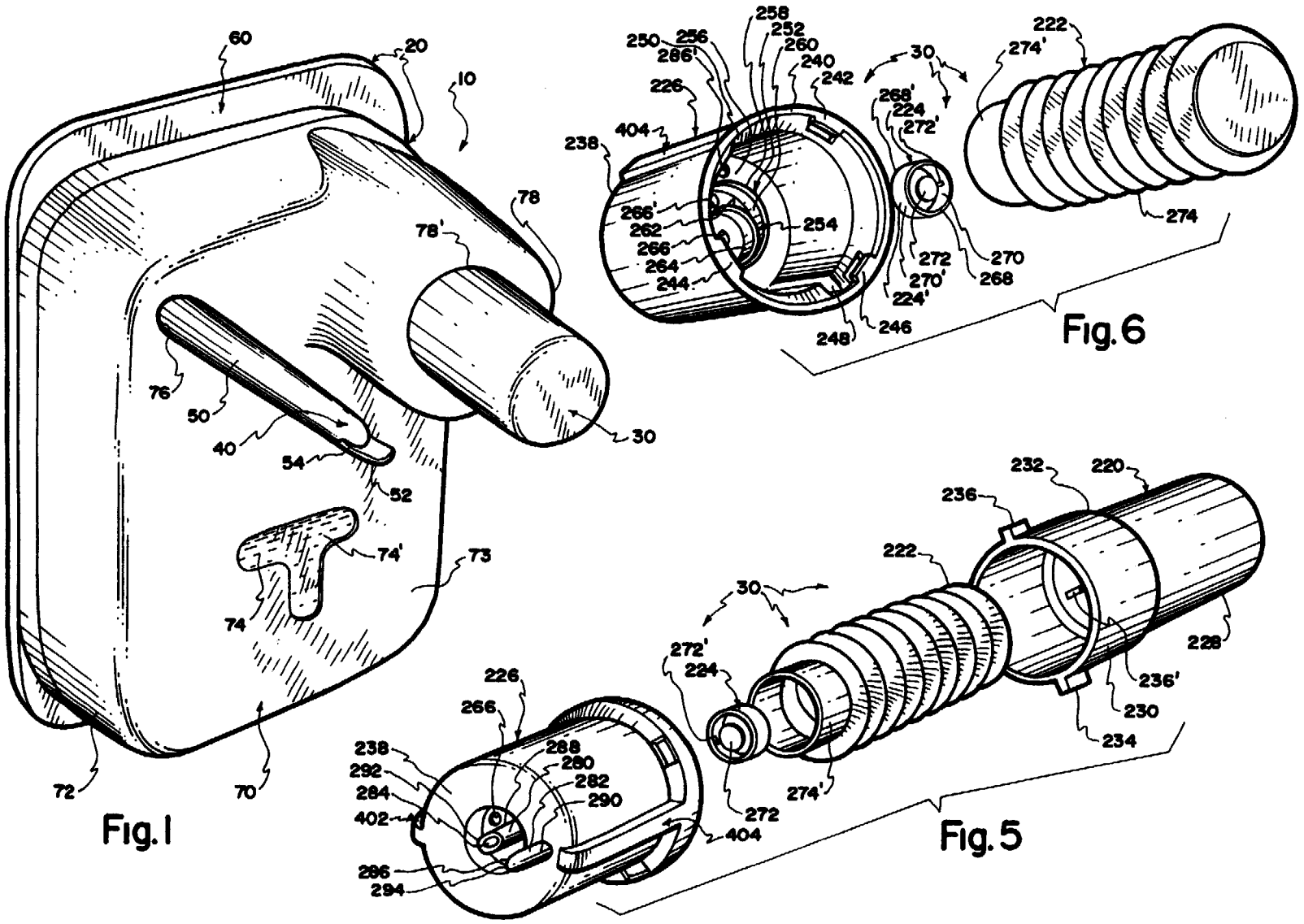
FIG. 1 is an exterior superior frontal perspective of a foam dispensing assembly.
FIG. 5 is an exploded perspective of the pump.
FIG. 6 is an exploded perspective of the pump with an interior view of a pump housing and including one-way valve parts and a pump bellows.

Reference is now made to the embodiment illustrated in FIGS. 1-16 wherein like numerals are used to designate like parts throughout. Referring to FIG. 1, a foam producing assembly 10 comprises a vertically oriented, wall mounted foam dispensing apparatus. As seen in a frontal exterior view, assembly 10 comprises a housing or cartridge holder 20, a manual air pump 30, and a foam dispensing container or cartridge 40. Only a spout 50 of cartridge 40 is seen in FIG. 1; however, foam dispensing cartridge 40 is described in detail hereafter. Spout 50 is in a pre-dispense, unopened state comprising a sealing plug 52 which is used to protectively seal cartridge 40 from access through an effluent orifice 54 disposed in the proximal end of spout 50. Removal of plug 52 provides a pathway for effluent foam 56 (see FIG. 2) through spout 50 and out of orifice 54.

Housing 20 comprises a back or mounting panel or plate 60 and a front cover 70. Front cover 70 comprises a cartridge 40 containing receptacle 72 which comprises a substantially planar proximal front face 73. Front face 73 comprises a transparent window 74 used to observe and monitor a residual level of a foamable-liquid 74' resident in foam dispensing cartridge 40 and viewable through an exterior wall of cartridge 40 and window 74. Front cover face 73 further comprises a first orifice 76 through which spout 50 protrudes for effluent access and a bulbous proximal extension 78 which comprises a second orifice 78' into which pump 30 is inserted for operative contact with foam dispensing cartridge 40. While a broad spectrum of foamable-liquids may be used within the scope of the invention, consideration of the requirements for producing a contaminant free medical liquid foam is paramount in carefully controlling and limiting interactions between the housing 20, pump 30 and foam dispensing cartridge 40, as described in detail hereafter.

Figure 2:
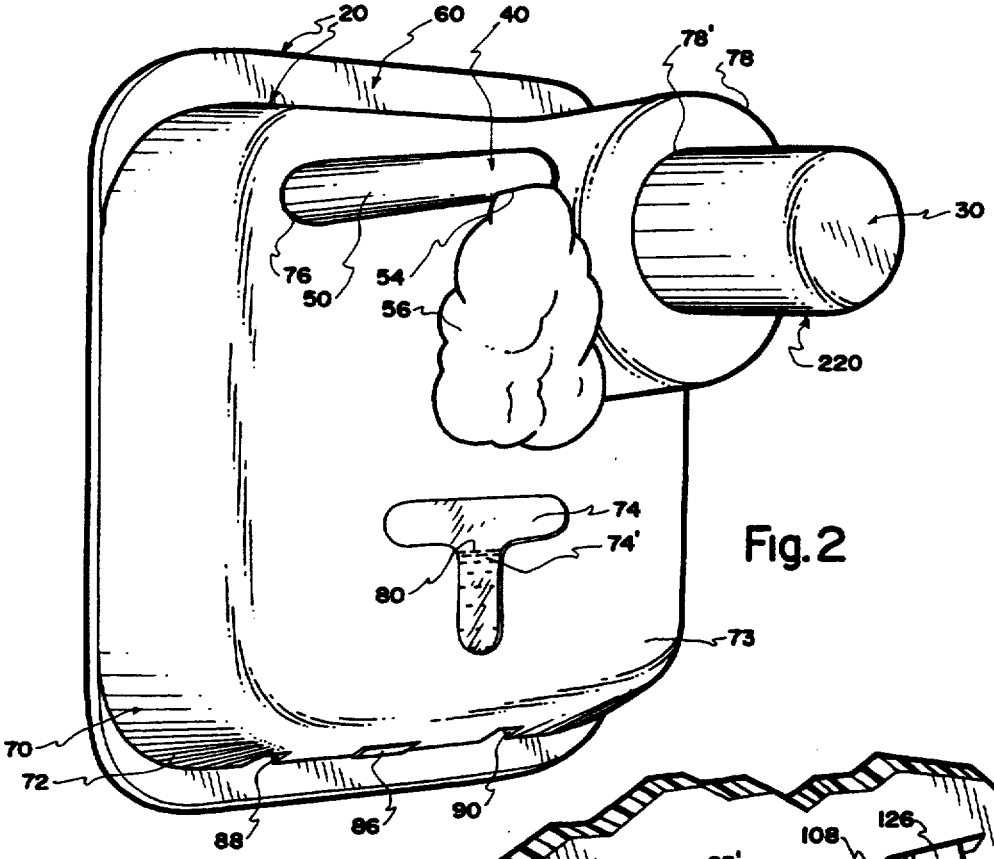
FIG. 2 is an exterior inferior frontal perspective of the foam dispensing assembly.

With a filled cartridge 40 in place in housing 20 and plug 52 removed from spout 50, reciprocal manual operation of pump 30 causes foam 56 to be extruded from spout 50, as best seen in FIG. 2. As foamable-liquid 74' is used from foam dispensing cartridge 40, a liquid level 80 becomes visible in window 74. Further use of foamable-liquid 74' causes liquid level 80 to drop toward a critical level whereat foam dispensing cartridge 40 should be replaced.

Access to inner contents of receptacle 72 is provided by release of a flush mounted, latch release 86, inferiorly disposed on back panel 60 to unlock latch cover 70 from back panel 60. Flush mounting of latch release 86 relative to cover 70 provides an element of security, whereby inadvertent contact of cover 70 or back panel 60 in an area surrounding latch release 86 does not mistakenly release cover 70 from latched attachment to back panel 60. In line with latch release 86 and juxtaposed back panel 60, cover 70 comprises a pair of notches 88 and 90 wherein portions of compound hinges, each comprising a toggle mechanism for both pivoting and separating the front housing or cover 70 from the back plate or panel 60 and described in detail hereafter, freely rotate while cover 70 is opened to permit replacement of cartridge 40.

Figure 3:
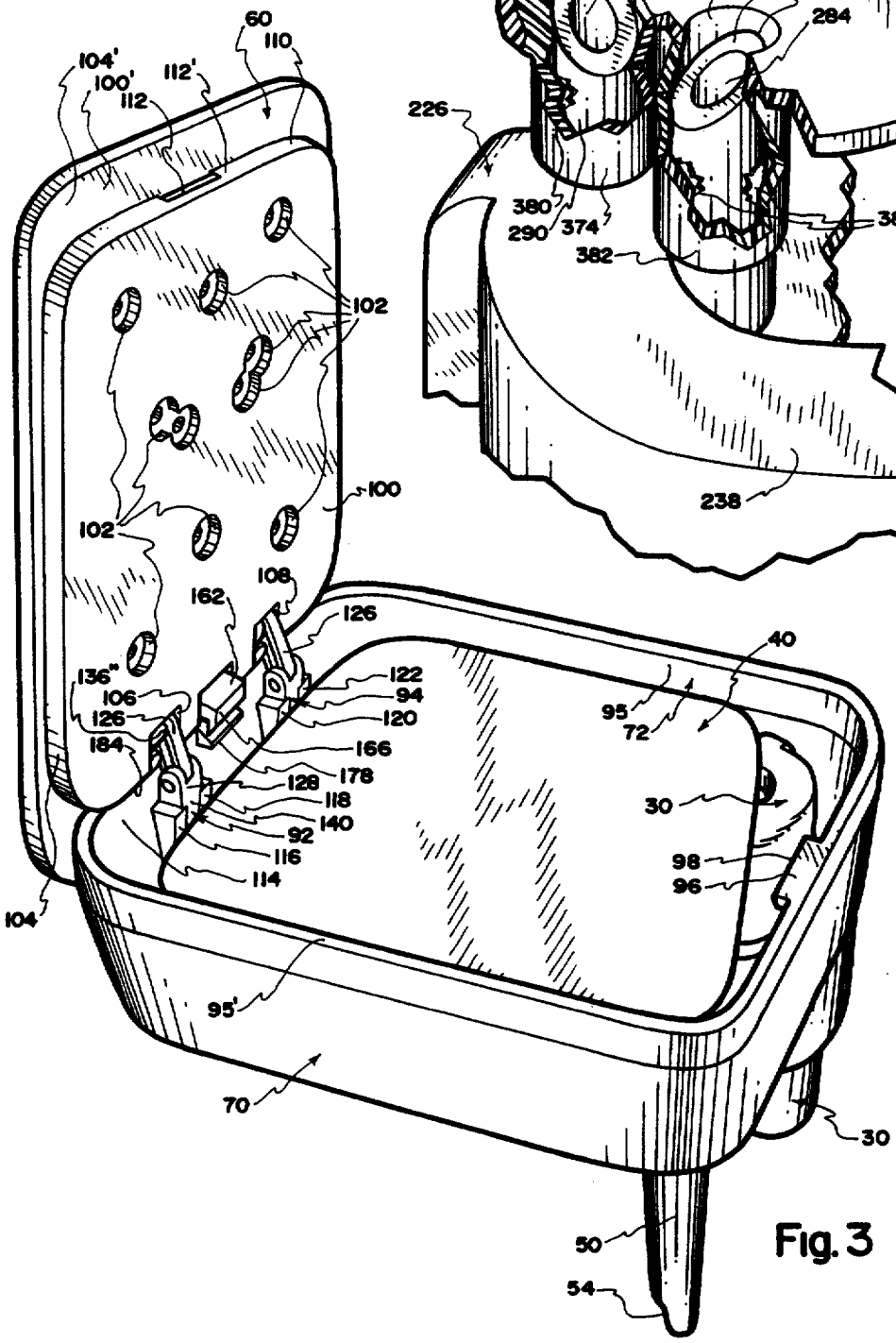
FIG. 3 is a frontal perspective of an opened foam dispensing assembly housing showing a foamable-liquid transport and foaming container or cartridge and a manual air pump disposed in a cover of the housing.

Access to the inside of receptacle 72 for facile replacement of each spent foamable-liquid cartridge 40 is afforded by inwardly depressing and thereby releasing latch release 86 and opening cover 70 as seen in FIG. 3. Receptacle 72 is seen to contain all of cartridge 40 except the portion of spout 50 which protrudes from the proximal side of cover 70 as earlier described. A distal surface of pump 30 which coapts with cartridge 40 inside receptacle 72 is partially seen in FIG. 3 and described in greater detail hereafter.

Cover 70 is hingeably affixed to back panel 60 by a pair of compound hinges 92 and 94. As described earlier, cover 70 comprises a receptacle 72 which provides a facilely accessible repository 95 for cartridge 40 and pump 30. Disposed along the accessible face of an open cover 70 is a substantially planar edge 95' which closes against back panel 60 to provide a closed assembly 10 Integral with edge 95' cover 70 comprises a latch-tab 96 on a side opposite the side affixed to hinges 92 and 94. Latch tab 96 comprises an insertable lip 98 which extends medially from edge 95'.

Back panel 60 comprises a proximal mounting plate 100 and a distal back supporting ring 100' integrally connected to mounting plate 100. Mounting plate 100 comprises a plurality of recessed mounting holes, generally designated 102 and a peripheral edge 104 raised from a proximal surface 104' of supporting ring 100'. The recessed mounting holes 102 are disposed at predetermined locations within plate 100 for mounting to standard and nonstandard mounting brackets (not shown) and for direct attachment to a wall or the like. Inferiorly disposed relative to mounting holes 102 are two hinge slots 106 and 108 wherein hinges 92 and 94, respectively, are affixed. A top portion 112 of peripheral edge 104 comprises a medially disposed slot 112, superiorly disposed relative to hinge slots 106 and 108. Slot 112 is sized to accept and hold latch-tab 96 when inserted in a downward motion relative to the substantially vertical orientation of back panel 60 as seen in FIG. 3. Conversely, latch-tab 96 is releasable from slot 112 by an upward motion relative to the vertical orientation of back panel 60.

Figure 9:
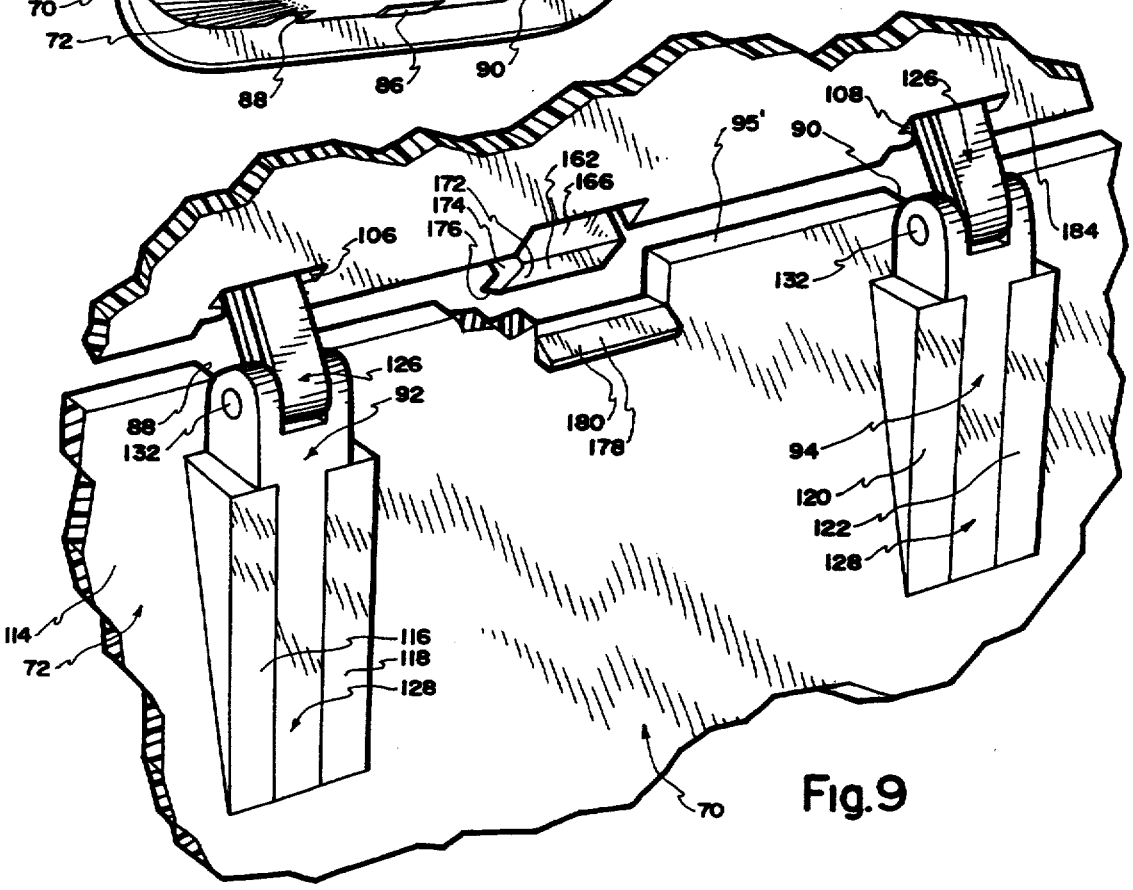
FIG. 9 is a segmented perspective of a portion of the housing showing details of compound hinges and a bottom latch with parts removed for clarity of presentation.
Figure 10:
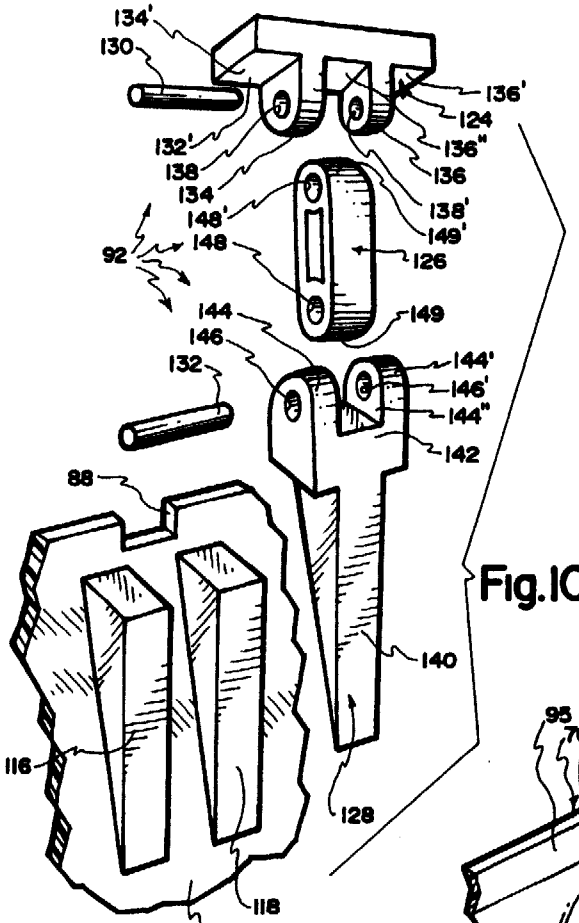
FIG. 10 is an exploded segmented perspective of one of the compound hinges seen in FIG. 9.

Greater detail of hinges 92 and 94 and related hinge parts is provided in FIGS. 9 and 10. As seen in FIGS. 3 and 9, receptacle 72 comprises an inner surface segment 114 which is inferiorly disposed when assembly 10 is closed and distally disposed relative to spout 50 when assembly 10 is opened for servicing of cartridge 40. Surface segment 114 comprises four wedge shaped hinge supports 116, 118, 120 and 122 protruding therefrom.

As hinge 94 is essentially the same in form and function as hinge 92, only hinge 92 will be described in detail. As seen in FIG. 10, hinge 92 comprises a back panel mount 124, a medially disposed connecting member 126, a cover connector 128, a back panel hinge pin 130 and a cover hinge pin 132. Back panel mount 124 comprises a rear retaining plate 132' from which a pair of ear shaped hinge supports 134 and 136 protrude normally, defining a "U" shaped yoke 136" therebetween. Extending laterally outward from each support 134 and 136, is a hinge retaining section 134' and 136', respectively. Hinge support 134 comprises an orifice 138 disposed centrally within hinge support 134 and parallel to the longitudinal axis of mount 124. Ear support 136 comprises a like orifice 138'.

Hinge pin 130 comprises a solid cylindrical rod having a transverse diameter which is sized to compressively retain pin 130 in orifices 138 and 138'. Hinge pin 130 is cut to a length which fills but does not extend laterally beyond orifices 138 and 138' when inserted therein.

Cover connector 128 is "T" shaped, comprising a wedge shaped stem 140 which closes fits within the space between hinge supports 116 and 118 along surface 114. A cross member 142 of connector 128 residing at the end of the thickest portion of stem 140 comprises a pair of ears 144 and 144' extending away from stem 140 and defining a "U" shaped yoke 144", therebetween. Ear 144 comprises a through orifice 146 which opens to yoke 144". Ear 144' comprises a through orifice 146' of essentially the same size as orifice 146' juxtaposed orifice 146 across yoke 144".

Hinge pin 132 comprises a solid cylindrical rod having a transverse diameter which is sized to compressively retain pin 132 in orifices 146 and 146'. Hinge pin 132 is cut to a length which fills but does not extend laterally beyond orifices 138 and 138' when inserted therein.

Connecting member 126 is an elongated member comprising a pair of transverse holes 148 and 148', one hole 148,148' disposed at each end of member 126. On one end 149', connecting member 126 comprises a transverse width which fits loosely within yoke 136" and associated hole 148' comprises a diameter which loosely receives pin 130. As such, when member 126 is disposed within yoke 136" and pin 130 is retainably disposed within orifices 138 and 138' and through hole 148', member 126 rotates freely about pin 130 to form a first hinge connection.

Similarly on the other end 149, connecting member 126 comprises a transverse width which fits loosely within yoke 144" and associated hole 148 comprises a diameter which loosely receives pin 132. As such, when member 126 is disposed within yoke 144" and pin 132 is retainably disposed within orifices 146 and 146' and through hole 148, member 126 rotates freely about pin 132 to form a second hinge connection. While the separation between ears 134 and 136 across yoke 136" may be different than the separation across yoke 144" between ears 144 and 144', it is preferable that such separations be the same. Also it is preferable that the transverse diameters of pins 130 and 132 be the same, thereby permitting ends 149 and 149' of connecting member 126 comprising holes 148 and 148', respectively, to be used interchangeably within yokes 136" and 144".

Pins 130 and 132 are preferably made from stainless steel rod but may be made from any material which is compatible with forces applied to hinges 92 and 94 and which is also compatible with a medical foaming station environment. Back panel mount 124, member 126 and connector 128 are preferably injection molded from rigid synthetic resinous material. One presently preferred material is A.B.S. and is available from Polymerland G.E.

Figure 4:
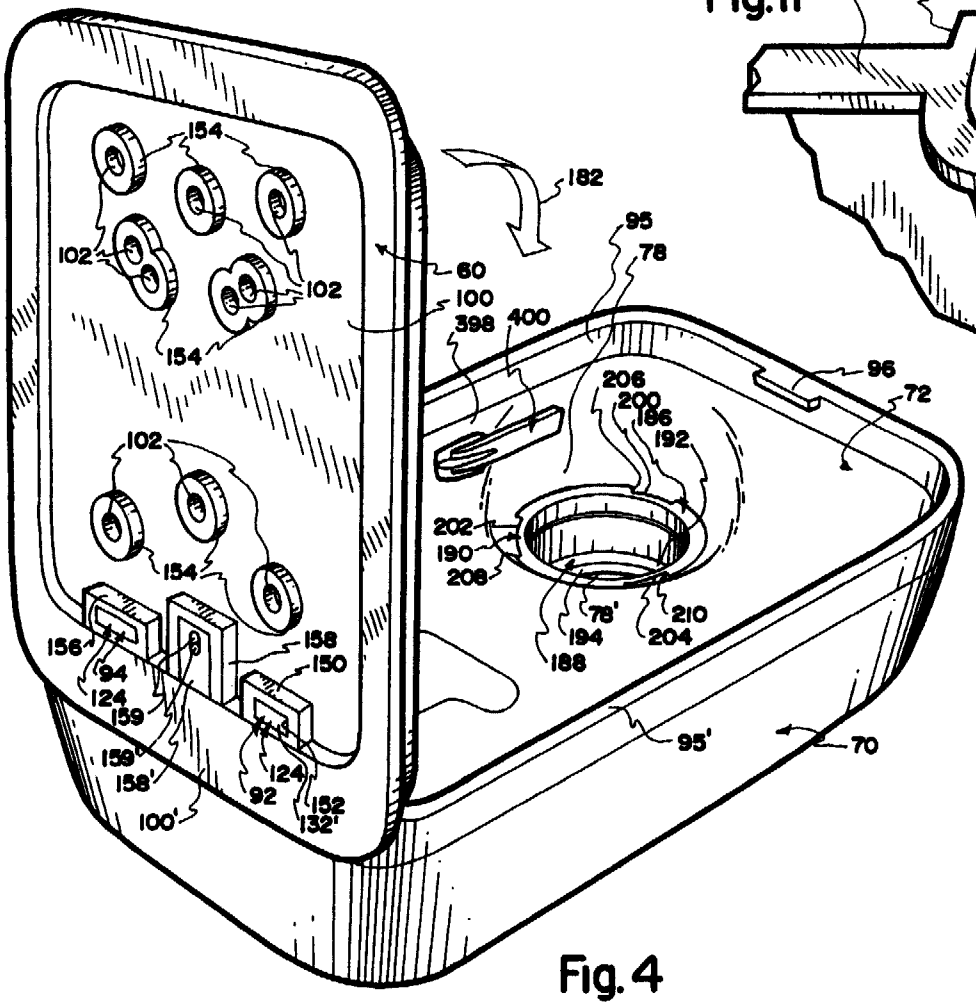
FIG. 4 is an exterior rear perspective of the opened assembly housing with the container and pump removed.

To hingeably affix back panel 60 to cover 70, hinge parts comprising one back panel mount 124, one medially disposed connecting member 126, one cover connector 128, one back panel hinge pin 130 and one cover hinge pin 132 are assembled as described above. Reference is now made to FIGS. 3 and 4 which show front and back sides of back panel 60, respectively, for the purpose of describing capture of hinge 92 by back panel 60. As seen in FIG. 4, back panel 60 comprises a raised block 150 disposed adjacent the site of hinge 92 and integral with proximal mounting plate 100 on a proximal side and a raised portion of back supporting ring 100' on an inferior side. Block 150 is juxtaposed slot 106 seen on the proximal side of plate 100 in the proximal side view of FIG. 3. Block 150 comprises a rectangular aperture 152 sized to receive rear retaining plate 132'. However, slot 106 in plate 100 is sized to pass only those parts of rear retaining plate 132' associated with yoke 136" and those other portions of hinge 92 associated with connecting member 126, cover connector 128, back panel hinge pin 130 and cover hinge pin 132. For this reason, when hinge 92 is inserted in a proximal direction through rectangular aperture 152, rear retaining plate 132 is captured before travelling through slot 106.

As best seen in FIG. 9, stem 140 of cover connector 128 is placed between hinge supports 116 and 118 along surface 114 and bonded or otherwise permanently affixed thereto. It should be noted that notch 88 is disposed to permit connecting member 126 passage through a predetermined portion of edge 95' for freer operation of hinge 92 as cover 70 is moved relative to back panel 60 to open assembly 10 and dispose cover 70 for servicing and replacement of cartridge 40 and, when necessary, pump 30. Such servicing and replacement and criteria therefor are described in detail hereafter.

Referring once more to FIG. 4, which shows an distal side view of back panel 60, each mounting hole 102 of plate 100 is seen to comprise a standoff, generally designated 154. Back panel 60 also comprises a second raised block 156 which is integral with proximal mounting plate 100 on a proximal side and a raised portion of back supporting ring 100' on an inferior site. Block 156 serves the same function and purpose for hinge 94 that block 150 serves for hinge 92. Hinge 94 is assembled and captured within block 156 juxtaposed slot 108 to hingeably interconnect cover 70 and back panel 60.

Figure 15:
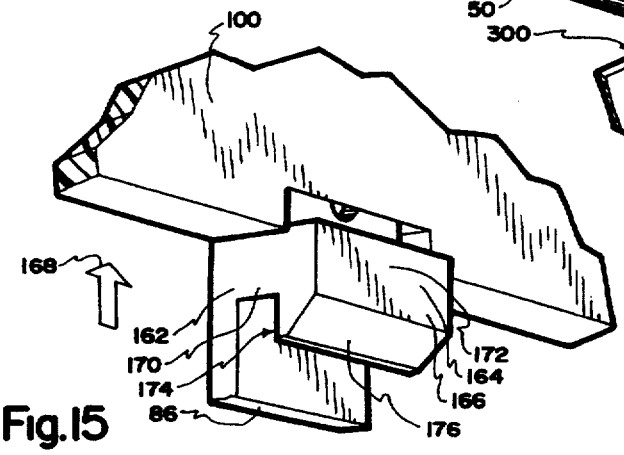
FIG. 15 is a segmented perspective of a latch portion of the housing.

Medially disposed between blocks 150 and 156 on back panel 60 is a latch capture block 158. Latch capture block 158 is also integral with a distal side of proximal mounting plate and integrally associated with back supporting ring 100' on an inferior side of block 158. Latch capture block 158 comprises a hollow cavity (not shown) disposed under a latch mechanism cover 158' to contain therein a memory biased latching mechanism 162. As seen in FIGS. 2 and 15, latching mechanism 162 comprises a latch actuator 164 and a counter release spring (not shown) which is disposed with the hollow cavity of latch capture block 158 and covered by latch mechanism cover 158'. After assembly of latching mechanism 162 within latch capture block 158, latch mechanism cover 158' is displaced over the hollow cavity and bonded or otherwise securely affixed in place. Note that cover 158' comprises a slot 159 which captures a retaining pin 159' which is a part of latching mechanism 162 to restrict travel of latching mechanism 162 against force of the counter release spring. Such spring impeded latching mechanisms are well known in latching mechanism art and is therefore not described in greater detail. However, release of cover 70 from closed attachment to back panel 60 and subsequent positioning of cover 70 relative to back panel 60 for servicing and replacement of disposable cartridge 40 and optional servicing and replacement of pump 30 is an important feature of the invention and described in additional detail hereafter.

As best seen in FIG. 15, latch actuator 164 comprises the latch release 86, previously described, and a clasp 166. Force of the counter release spring is opposite to the direction of arrow 168. Clasp 166 is integrally associated with latch release 86 and comprises an offset 170 therefrom to a proximally disposed clasping member 172. In combination, latch release 86, offset 170 and clasping member 172 form an inverted "J" shaped hook 174. Clasping member 172 comprises an inferiorly disposed bevel 176 on the proximal side thereof.

A complementary cover 70 catch 178 is best seen in FIGS. 3 and 9. Juxtaposed clasping member 172 along edge 95' and surface 114, catch 178 protrudes medially into receptacle 72 as best seen in FIG. 9. Catch 178 comprises a surface bevel 180 which is complementary to the juxtaposed bevel 176 of clasp 166. The combined angles of the bevels provide a movement of latching mechanism 162 in the direction of arrow 168 (see FIG. 15) when edge 95' of cover 70 is closed against back panel 60. Thereby, an action of closing of cover 70 against back panel 60 causes clasp 166 to move in the direction of arrow 168 until bevel 180 of catch 178 clears clasp 166 and is resultingly caught within hook 174 to secure the latch. Latch release 86 is depressed in the direction of arrow 168 against the counter release spring to unlatch cover 70 from back panel 60 and provide access to cartridge 40 and pump 30 thereby.

When opening cover 70 from back panel 60, latch release 86 is depressed and cover 70 is moved proximally from back panel 60 a distance permitted by extension of each hinge 92 and 94 allowing catch 180 to clear hook 174. As mentioned earlier, latch-tab 96 is releasable from slot 112 (seen in FIG. 8) by an upward motion relative to the vertical orientation of back panel 60, providing a pair of locks thereby, one at the top and the other at the bottom of holder 20. Once catch 180 is clear of hook 174, cover 70 is moved in an upward direction to remove latch-tab 96 from slot 112. Afterward, cover 70 is opened by rotating cover 70 in the direction of arrow 182 (see FIG. 4).

As will be clear from the description that follows, it is important that cover 70 be adequately supported in an open or horizontal orientation. To accomplish this, the length of each connecting member 126 is adjusted such that in one horizontal orientation of cover 70, edge 95' is supported by an inferior edge 184 of plate 100 as seen in FIG. 3. In another horizontal orientation of cover 70, depth of notches 88 and 90 below edge 95', seen in FIG. 9, are adjusted to provide support for connecting members 126 when cover 70 is horizontal and edge 95' is not disposed below edge 184.

Attention is again drawn to FIG. 4 wherein cover 70 is open and empty to reveal the portion of receptacle 72 where bulbous proximal extension 78 provides an internal connecting site 186 for pump 30. Connecting site 186 comprises a pump actuator retaining ring 188 and a pump housing retaining ring 190. Actuator retaining ring 188 comprises a smooth circular ledge 192 and a reduced diameter interior surface 194 which opens to provide second orifice 78' through which pump 30 extends for external access and manual actuation.

Figure 16:
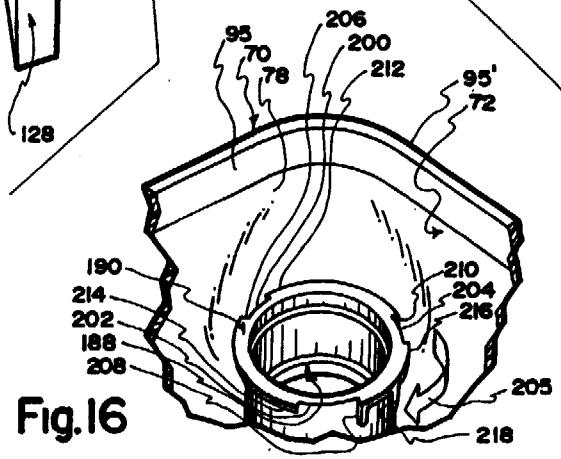
FIG. 16 is a segmented perspective of the housing of FIG. 4, with parts removed to show a pump portion of a cover of the housing.

Pump housing retaining ring 190, which is better seen in FIG. 16, comprises three radial slots 200, 202 and 204 for keyed positioning and assembly of pump 30 within receptacle 72. At least one of the three radial slots 200, 202 and 204 comprises a greater radial length than one of the other of the three radial slots. As an example, in this embodiment, slot 202 is larger than slots 204 and 200. Adjacent each slot 200, 202 and 204, disposed in a first radial direction which is counter to the direction of arrow 205, is a stop 206, 208, and 210, respectively which prevents rotation of an inserted part in the first radial direction. Adjacent each slot 200, 202, and 204 and disposed in a second radial direction therefrom is a rim segment 212, 214 and 216, respectively, under which a compatible pump member rotates and is securely affixed. A stop, commonly designated 218, is inferiorly disposed and thereat provided at the end of each rim segment 212, 214 and 216 to accurately limit the angular distance of locking rotation in the direction of arrow 205 of an inserted pump 30 and thereby determine the angular position of an inserted and rotated to a stop position pump 30 relative to a predetermined site of cartridge 49 within cover 70, such as orifice 76 for spout 50. A controlled alignment of pump 30 relative to cartridge 40 is important for reasons which are clarified hereafter.

Unless otherwise specified all back panel 60 and cover 70 parts are preferably made from opaque, rigid synthetic resinous material. It is presently preferred that back panel 60 and cover 70 be injection molded from A.B.S., available from Polymerland G.E. The window 74, which is preferably transparent or at least translucent, is preferably made from synthetic resinous material which is bondable to the synthetic resinous material used for cover 70. It is presently preferred that window 74 be made from acrylic, available from General Polymers.

Although any pump which can be attached and used as an intermittent source of pressurized gas for cartridge 40 can be employed with assembly 10, it is preferred that pump 30 be a bellows pump. As seen in FIGS. 5 and 6, pump 30 comprises a pump actuator 220, a pump bellows 222, a check valve member 224 and a pump housing 226.

As best seen in FIG. 5, pump actuator 220 is cylindrical in form and comprises a closed proximal actuating end 228 and a bellows containing end 230. Actuating end 228 comprises a length which permits actuator 220 to extend proximally from orifice 78' of cover 70 a predetermined distance which is effectively a pump stroke length. Externally disposed at an interface between end 228 and end 230 is a circular shelf 232. End 228 comprises a transverse diameter which is somewhat less than the diameter of orifice 78' to allow facile travel of end 228 through orifice 78'. Shelf 232 enlarges the transverse diameter of actuator 220 such that end 230 does not fit through orifice 78'. Therefore actuator 220 inserted into orifice 78' from inside cover 70 is captured and partially retained therein.

Externally disposed at the distal end of actuator 220 are a plurality of guide members, seen in this embodiment to be guide members 234 and 236. Each guide member 234 and 236 comprises a radial, rectangular protrusion used to follow a guide groove within the pump housing to maintain a constant radial orientation while reciprocating actuator 220 for more facile operation. A plurality of bellows 222 engaging members, generally designated 236', are disposed inside end 228 to provide stroke length determining, bellows contacting engagement with the proximal end of bellows 222.

Referring to FIG. 6, pump housing 226 is a cap-shaped object, closed at one end by a cartridge 40 engaging surface 238. At a proximal opening or brim end 240, housing 226 comprises a plurality of radially inwardly radiating tabs 242, 244 and 246 which are complementary in form and radial position to slots 200, 202 and 204, respectively, of connecting site 186 inside cover 70 (see FIG. 4). Thereby, when pump housing 226 is disposed upon retaining ring 190 such that tabs 242, 244 and 246 engage and communicate through respective slots 200, 202, and 204, pump housing 226 is only able to be rotated in a single radial direction to a fixed position within retaining ring 190 as earlier described.

Disposed along the sides of pump housing 226 are a pair of longitudinally directed guide channels 248 and 250 having depths, widths and angular positions corresponding to guide members 234 and 236. Insertion of guide members 234 and 236 into guide channels 248 and 250 assures linear reciprocation of actuator 220 within housing 226.

At the base or distal surface 238 end of pump housing 226, housing 226 internally comprises a pair of asymmetrically oriented and mostly closed on one end cylindrical chambers 252 and 254 each integrally affixed to an interior end surface 256 juxtaposed distal surface 238. Cylindrical chamber 252 comprises an exterior cylindrical surface 258 and an interior cylindrical surface 260, each of which extend normally from surface 256 a sufficient distance to form a compressibly joinable cylinder for a throat of a bellows pump. Cylinder 254 comprises a smaller diameter than cylinder 252, an exterior cylindrical surface 262 and an interior cylindrical surface 264. Cylinder 254 is disposed within cylinder 252 in an asymmetrical offset such that exterior surface 262 of cylinder 254 is in tangential contact with interior surface 260 of cylinder 252. Centrally disposed within cylinder 254 is a hole 266 which passes through surfaces 238 and 256. In space within cylinder 252, but outside cylinder 254, cylinder 252 comprises a hole 266' which also passes through surfaces 238 and 256.

Check valve member 224 comprises a substantially hollow cylinder 224' comprising a proximal rim 268, a distal rim 268', an internal cylindrical surface 270 and an external cylindrical surface 270'. Centrally disposed within cylinder 224' in the plane of distal rim 268' valve member 224 further comprises a circular planar leaf member 272 and a thin stem 272' which attaches leaf member 272 to interior surface 270. Cylinder 224' is sized to be displaced into cylinder 254 with external surface 270' in compressive contact with interior surface 264 such that when check valve member 224 is disposed within cylinder 254, circular leaf member 272 is disposed over and in close proximity to hole 266. Leaf ember 272 is sized to completely cover hole 266 and stem 272' comprises a resilient attachment to cylinder 224' such a so placed check valve member 224 is permissive to fluid flow, in a first direction, permitting influent proximal flow through a very low resistance, but effectively checks fluid flow in a second distal direction with an extremely high resistance.

Bellows 222 comprises a bellows section 274 and an open throat 274'. Such bellows are well known in the art and are often made by blow molding. Throat 274' comprises diametral dimensions which cause throat 274' to make a sealed connection with surface 258 when throat 274' is forcibly displaced over cylinder 252. When bellows 222 is so connected to cylinder 252, reciprocal displacement of bellows section 274 causes influent fluid flow into bellows 222 through hole 266 when bellows section 274 is moved proximally and effluent fluid flow out of bellows 222 through hole 266' when bellows section is moved distally, thereby providing an effective manual one-way fluid pump for assembly 10.

Attention is now drawn to FIG. 5, where cartridge 40 engaging surface 238 of pump housing 226 is clearly seen. Housing 226 further comprises a medially disposed hollow fluid passing shaft or stem 280, a more radially disposed hollow fluid passing shaft or hollow stem 282, and orifice 266. As such, orifice 266 provides access to ambient fluid and fluid pressure such as air and ambient air pressure providing a passageway for influent fluid flow into pump 30. Shaft 280 comprises a hollow passageway 284 which communicates with hole 266' to carry fluid flow effluent from pump 30. Shaft 282 comprises a hollow passageway 286, better seen in FIG. 13. Passageway 286 leads through shaft 282 to a an aperture 286' disposed in surface 256 of pump housing 226 (best seen in FIG. 5). Each shaft 280 and 282 comprises a rigid cylindrical supporting column 288 and 290, respectively. Each column 288 and 290 comprises a sharp end 292 and 294, respectively, capable of breaking a frangible part in cartridge 40 for purposes described in detail hereafter.

Pump actuator 220 and pump housing 226 are preferably made from opaque, rigid synthetic resinous material. As such, it is presently preferred that actuator 220 and housing 226 be injection molded from A.B.S., available from Polymerland G.E. Bellows 222 is preferably made from pliant, shape recovering synthetic resinous material. Bellows 222 may be blow molded from polyethylene, generally commercially available from a wide variety of sources. Check valve member 224 is preferably made from resilient, shape retaining synthetic resinous material. Check valve member is presently preferably injection molded from POLYETHYLENE 1870, available from Eastman Fiberchem.

Figure 7:
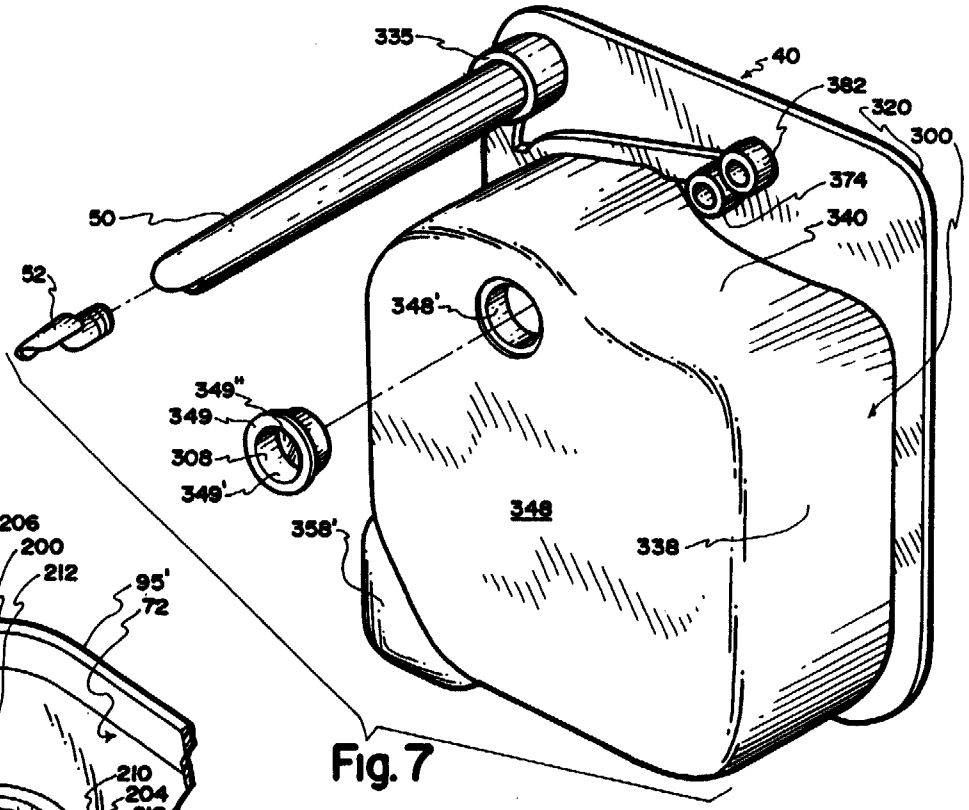
FIG. 7 is an exploded frontal perspective of the foamable-liquid container.
Figure 8:
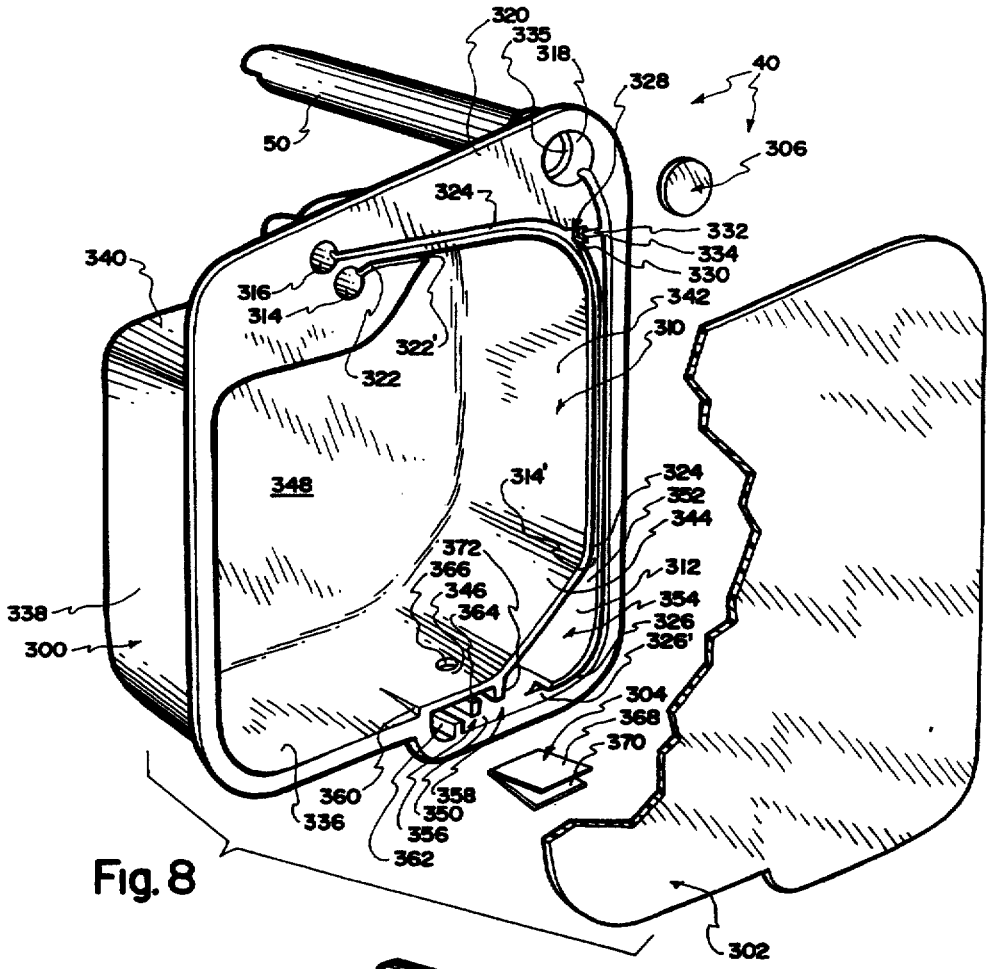
FIG. 8 is an exploded rear perspective of the container which comprises a molded body or tray and a body or tray sealing sheet.

Attention is now drawn to FIGS. 7 and 8 wherein, in combination, parts comprised in foam dispensing cartridge 40 are seen. As seen in FIG. 8, cartridge 40 comprises an open faced tray container 300, a tray face enclosing sheet 302, a valve leaflet 304 and a foam homogenizing disk 306. In the opposite side view of tray container 300 seen in FIG. 7, tray container 300 further is seen to comprise plug 52, previously mentioned, and a fill-plug 308.

As best seen in FIG. 8, tray container 300 is a three dimensional part comprising a first relatively large, superiorly disposed cavity or reservoir 310, a relatively small, inferiorly disposed reservoir or pump chamber 312, a first fluid inlet port 314, a second fluid inlet port 316 and an effluent port 318. Each port is superiorly disposed relative to reservoirs 310 and 312 and are so constrained and oriented while container 300 is being used. Except for communicating orifices to fluid carrying channels which are interposed between the reservoirs and the ports, each port 314, 316 and 318 and each reservoir 310 and 312 is bounded by a bordering surface member 320 disposed at the face of tray container 300.

Figure 14:
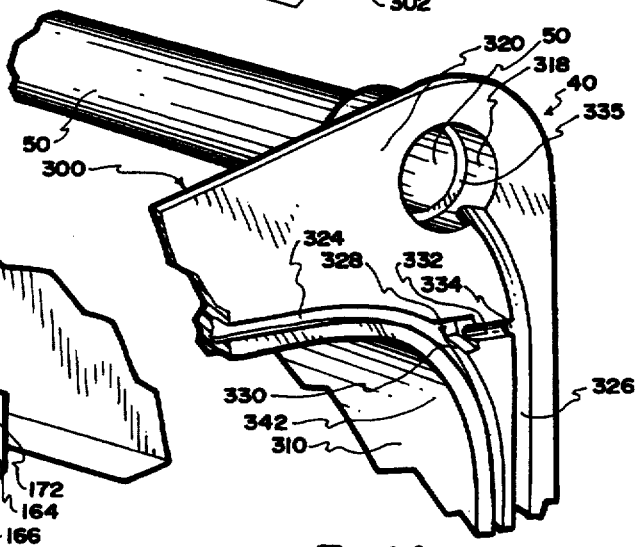
FIG. 14 is an exploded segmental perspective of a foam outlet port of the container.

Disposed as an open faced groove in member 320 and interposed between port 314 and reservoir 310 is a first channel or passageway 322 which communicates influent fluid, such as ambient air, entering through port 314 to a superior site 322' in reservoir 310. Similarly, a second channel or passageway 324 is disposed as an open faced groove between port 316 and reservoir 312 and communicates fluid entering through port 316 to a superior site 324' in reservoir 312. A third channel 326 also disposed as an open faced groove in member 320 communicates fluid from an inferior site 326' in reservoir 312 to port 318. Interposed between channel 324 and channel 326 at a site which is superior to site 324' is a high resistance channel 328 which is best seen in FIG. 14. Channel 328 comprises a flow dividing interface 330 to channel 324 which narrows from a intersection with channel 324 to a relatively narrow, relatively high resistance passageway 332 which forms a gas velocity increasing nozzle which opens into channel 326 at a site 334. When foamable-liquid 74' is coursing through channel 326, under pressure from a gas, such as pressurized air in channel 324, foamable-liquid 74' is foamed at site 334.

Referring once more to FIG. 8, foam homogenizing disk 306 is sized to be disposed entirely across port 318 when inserted therein. Tray 300 comprises a circular shelf 335 disposed at the junction between port 318 and spout 50. Shelf 335 provides a stop which limits further travel of each disk 306 inserted into spout 50.

Reservoir 310 comprises a plurality of integrally connected exterior wall segments 336, 338, 340 and 342 and two additional integrally connected interior wall segments 344 and 346. Each wall segment 336, 338, 340, 342, 344 and 346 is integrally joined to an orthogonally disposed reservoir enclosing base member 348 to form open faced reservoir 310.

Enclosing member 348 disposed at the base of reservoir 310 further comprises a fill port 348' through which an other wise completely closed and sealed tray 300 accommodates receipt of foamable-liquid 74' into reservoir 310, as seen in FIG. 7. Fill-plug 308 comprises a top hat shape comprising a brim 349, a cylindrical wall 249'; and an enclosing top 349''. So shaped, fill-plug 308 is sized to close tray for transport and storage by insertion and bonding of fill-plug 308 into fill-port 348' which comprises a complementary sealing surface to fill-plug 308 brim 349 and wall 349' parts.

Like reservoir 310, but of much smaller dimensions, reservoir 312 comprises exterior wall segments 350 and 352 and interior wall segments 344 and 346. However, reservoir 312 is a chamber comprising two joined blind cavities 354 and 356. Cavity 354 is larger than cavity 356 and comprises wall segments 344 and 350 integrally joined to an orthogonally disposed reservoir enclosing member 358' (see FIG. 7). Except for a communicating trough 358 which fluidically joins cavities 354 and 356, cavity 356 is enclosed by wall segments 346 and 350. As a reference, a ridge member 360 superiorly disposed between wall segments 346 and 336 comprises a length which is substantially the same length as cavity 356 is deep.

Disposed on the inner side of exterior wall segment 350 is a valve leaflet support member 362 which extends from face defining member 320 to the deepest point of cavity 356 in a first direction and from the inner side of exterior wall segment 350 approximately one-half the distance to wall segment 346 in a second direction. As an example, if the normal interior distance between wall segment 346 to wall segment 350 is 0.8 centimeters, the second direction distance is 0.4 centimeters. Second valve leaflet support member 364 is removed a distance away from member 320 to facilitate liquid flow from cavity 356 to site 326', but otherwise comprises the same dimensions as valve leaflet support member 362. Second support member 364 is also displaced from support member 362 a distance which affords stable support for valve leaflet 304.

Figure 11:
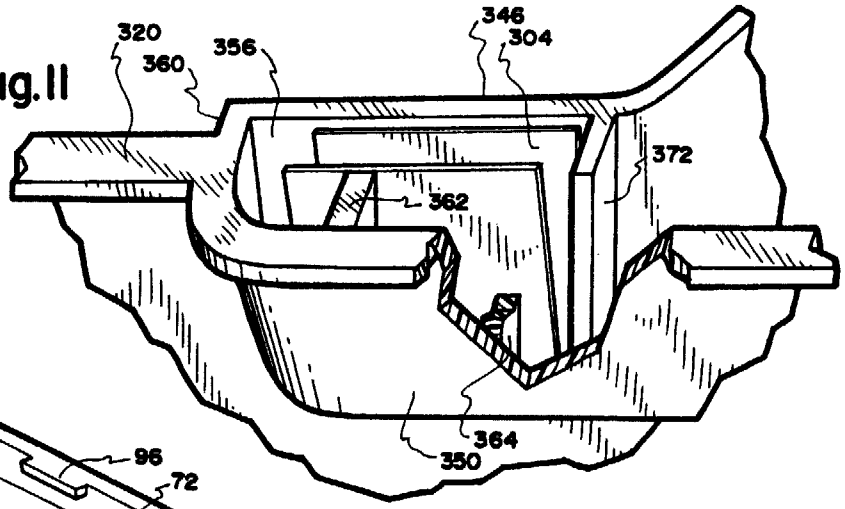
FIG. 11 is a magnified segmented perspective of the one-way valve between smaller and larger chambers of the container.

As best seen in FIG. 8, reservoirs 310 and 312 share opposite sides of interior wall segment 346. Disposed in wall segment 346 is at least one foamable-liquid 74' communicating aperture 366, which is permissive to liquid flow between reservoirs 310 and 312. When reservoirs 310 and 312 are oriented such that reservoir 310 is superior to cavity 356 as seen in FIG. 8, and vacuum relieving air is supplied through port 314 gravity forces fluid from reservoir 310 into cavity 356 and, therefore, into reservoir 312. To stop undesirable pressure relieving fluid flow from reservoir 312 into reservoir 310, when foam creating fluid, such as pressurized air, is introduced into reservoir 312, leaflet 304 is disposed across valve leaflet supports 362 and 364 as seen in FIG. 11. When pressure is increased in reservoir 312, valve leaflet 304 is forcibly displaced against the inferior side of wall segment 346 to close aperture 366 to fluid flow from reservoir 312 to reservoir 310.

As seen in FIGS. 8 and 11, valve leaflet 304 comprises a shape maintaining folded sheet which is preferably made from a non-wettable, liquid impervious material with shape retaining memory. The presently preferred material used for leaflet 304 is polyester film, available from Plastic Suppliers, Los Angeles, Calif. A simple fold, dividing the folded sheet into a superiorly disposed half 368 and an inferiorly disposed half 370 and trimmed to a predetermined size to be inserted into cavity 356 in the manner seen in FIG. 11 provides an inherently, self-biasing stop or check valve leaflet 304. As best seen in FIG. 11, one additional valve leaflet capturing member 372 extends normally from wall segment 346 to a plane defined by the extension of valve leaflet supports 362 and 364.

As mentioned earlier, cartridge 40 is shipped in a sealed state. For operative use, cartridge 40 is displaced into cover 70 into which pump 30 is predisposed. Prior to use, cartridge 40 must be opened for fluid access at three previously sealed places, at spout 50, at port 314 and at port 316. In the present embodiment spout 50 is opened by manually removing plug 52 as earlier described.

Figure 12:
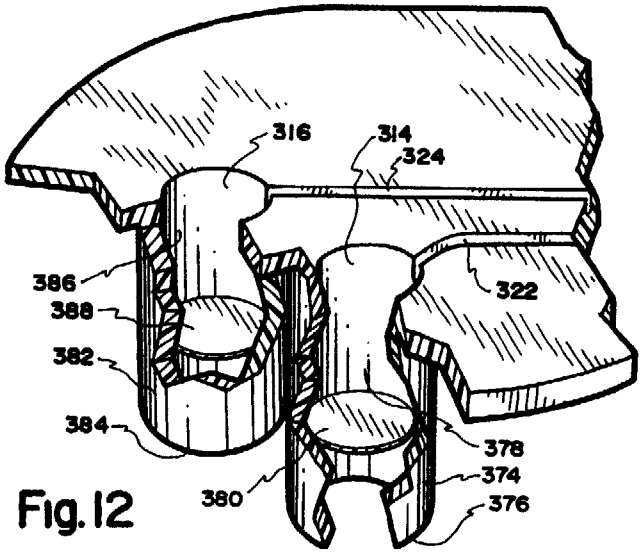
FIG. 12 is a magnified segmented perspective of frangible ports in the container tray at the bottom of blind bores.

As seen in FIG. 12, port 314 is integrally connected to a hollow post 374. Post 374 comprises a substantially circular inferior rim 376, a cylindrical inner surface 378 and a frangible disk 380. Frangible disk 380 is disposed sealingly across surface 378 and interposed between any interiorly disposed fluid conducting portion of channel 322 and rim 376. So disposed, frangible disk 380 is protected from being inadvertently broken leading to potential loss of foamable-liquid 74' and influent contamination.

In similar fashion, port 316 is integrally connected to a hollow post 382. Post 382 comprises a substantially circular inferior rim 384, a cylindrical inner surface 386 and a frangible disk 388. Frangible disk 388 is disposed sealingly across surface 386 and interposed between any interiorly disposed fluid conducting portion of channel 324 and rim 384. So disposed, frangible disk 388 is also protected from being inadvertently broken leading to potential loss of foamable-liquid 74' and influent contamination.

Figure 13:
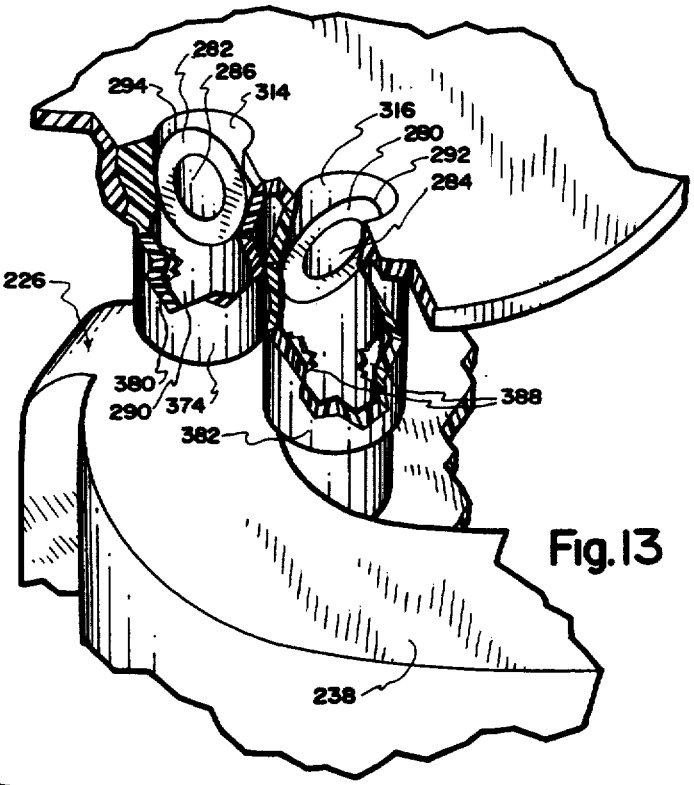
FIG. 13 is a magnified segmented perspective of the frangible ports in the container tray after being franged by hollow shafts or stems attached to the pump.

In combination, posts 374 and 382 comprise a post to post separation, internal diameters, and position relative to spout orifice 76 such that shafts 280 and 282 are facilely inserted when cartridge 40 is displaced into cover 70. Referring to FIG. 13, each shaft 280 and 282 is seen to comprise a length adequate to extend beyond frangible disks 380 and 388, respectively, when cartridge 40 is pressed downward to rest upon pump housing surface 238 of pump housing 226. By such an action, each shaft 280 and 282 franges each respective disk 388 and 380 and creates an airtight seal within each respective post 382 and 374. The connection of shaft 280 and post 382 provides a communicating pathway for pressurized fluid (such as air) from pump 30 to channel 324. The connection of shaft 282 and post 374 provides a communicating pathway for ambient air from inside pump housing 226 through aperture 286' to channel 322.

Foam dispensing cartridge 40 is assembled, filled and made ready for transport by first providing a tray container 300, a plug 52 for spout 50, a foam homogenizing disk 306, a valve leaflet sheet 304, a tray face enclosing sheet 302, and a tray fill-plug 308. As frangible disks 380 and 388 are unbroken and in place in an unused tray container 300, no assembly action is required relative to ports 314 and 316. Disk 306 is inserted into port 318 and seated against shelf 335. Valve leaflet sheet 304 is folded and inserted into cavity 356. Tray face enclosing sheet 302 is sealingly bonded against tray face defining member 320 to fully enclose all channels, ports and reservoirs within tray 300, except for fill-port 348'. Reservoir 310 is filled with foamable-liquid 74' through fill-port 348'. Fill-plug 308 is displaced into fill-port 348' and sealingly bonded to tray 300. Cartridge 40 may then be placed in a shipping container, if needed. Such may not be necessary as cartridge 40 is, by itself, an effective shipping container.

When liquid level 80 of foamable-liquid 74' as visualized through window 74 shows a spent cartridge 40 in assembly 10, housing 20 is opened by impressing latch release 86 to release clasp 166 from catch 178. Cover 70 is moved superiorly to raise latch-tab 96 from slot 112. Cover 70 is then rotated approximately 90° relative to back panel 60 to the position seen in FIG. 3. Spent foamable-liquid cartridge 40 is lifted from receptacle 72 of cover 70 and appropriately discarded. Shafts 280 and 282 are inspected for contamination. If either shaft 280 or 282 is contaminated, pump housing 226 is removed and a clean housing 226 is restored to retaining ring 190. In any event a replacement foamable-liquid cartridge 40 is placed tray face enclosing sheet 302 up such that spout 50 is inserted through orifice 76 and shafts 280 and 282 are inserted into posts 382 and 374, respectively. Cartridge 40 is forced downward upon shafts 280 and 282 to frange disks 388 and 380, respectively. Cover 70 is rotated to a vertical position and closed and latched against back panel 60. Plug 52 is removed from spout 50.

When cartridge 40 is so disposed within cover 70 and connected to pump 30, reciprocation of pump actuator 220 elicits foam 56 from spout 50. Pressurized air from pump 30 is injected through port 316 into channel 324. Pressurized air is communicated through channel 324 to a top surface of foamable-liquid 74' disposed in reservoir 312. So pressurized, foamable-liquid 74' is driven superiorly through channel 326 toward port 318. Pressurized air in channel 324 is divided at flow dividing interface 330. Air is injected into foamable-liquid 74' at foaming site 334 creating foam 56 which is propelled onward under force of air from port 316 to enter port 318, be homogenized while passing through foam homogenizing disk 306 and becomes effluently accessible through spout 50.

When pressure is relieved by further reciprocation of pump 30, the superior/inferior orientation of reservoir 310 relative to reservoir 312 across orifice 366 and valve leaflet 304 causes gravity forced flow of foamable-liquid 74' across orifice 366 to replenish reservoir 312 for liquid used while producing foam 56 during the previous pressure producing reciprocation of pump 30.

Tray 300 is preferably made from transparent or translucent liquid impervious, shape retaining synthetic resinous material. Tray 300 is presently preferably injection molded from high density polyethylene, available from Eastman Fiberchem. Tray face enclosing sheet 302 is preferably made from a thin film, liquid impervious, synthetic resinous sheet material which is bondable to the material used in tray 300. As such, sheet 302 is presently preferably made from a buried lamination of foil and polyester having a thermoactive coating on one side, product number M1411, available from American National Can. It should be borne in mind that materials used in tray 300 and sheet 302 must be liquid impermeable and essentially chemically and biologically inert relative to foamable-liquid 74' stored in cartridge 40. Foam homogenizing disk 306 is presently preferably made from fiber filter, generally widely available in commerce. Use of such materials for homogenizing foam is well known in the art.

It is conceivable that a cartridge may undergo sufficient acceleration during shipment (G-forces) to cause foamable-liquid 74' initially disposed in the large hollow region of cavity or reservoir 310 to be transported to either first inlet port 314 or second inlet port 316. In either case, such transport provides an opportunity for contamination of pump shafts or stems 280 and 282 subsequently leading to potential carry-over contamination of foamable-liquid 74' in a subsequently used cartridge 40. In such cases, corrective measures are taken by replacing or cleaning and sterilizing pump housing 226 at the same time a spent cartridge 40 is replaced.

As mentioned earlier, it is important to accurately control the in-use position of pump 30 relative to cartridge 40. Referring once more to FIG. 4, repository 95 is seen to comprise a vertical side wall 398 upon which a pump position locking pawl 400 is mounted. Pawl 400 is used to releasibly but securely, hold pump 30 in position relative to side wall 398 and, therefore, relative to orifice 76 and spout 50 and each inlet port 314 and 316 of cartridge 40.

Figure 17:
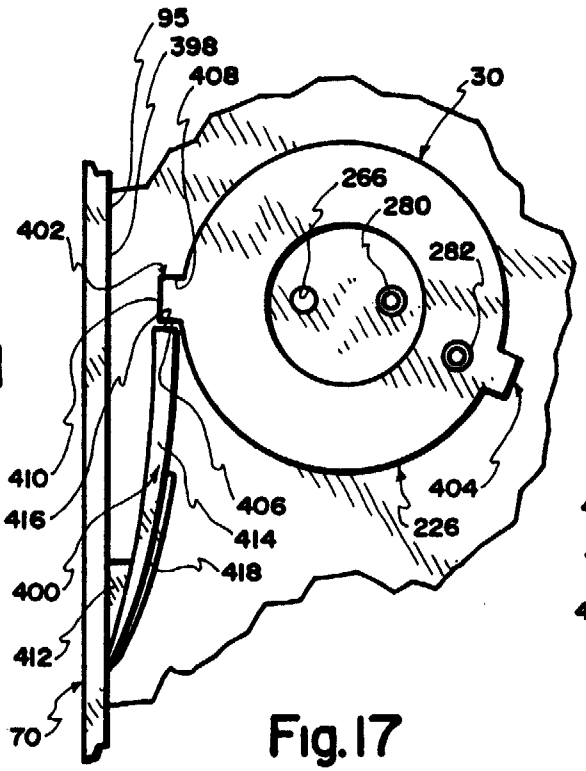
FIG. 17 is a top elevation of the pump installed into the cover with portions of the cover removed for clarity of presentation.

As best seen in FIGS. 5 and 6, pump housing 226 comprises two elongated raised members 402 and 404 which enclose channels 248 and 250, respectively. Referring to FIG. 17, member 402 comprises a pair of radially disposed surfaces 406 and 408 which are circumferentially connected by an enclosing surface 410. Member 404 is of substantially the same shape as member 402, but is disposed away from pawl 400 when pump 30 is installed into cover 70 and is not directly involved in positioning pump 30 relative to pawl 400.

Pawl 400 comprises a mounting base 412, a long tongue shaped arm 414 having a blunt end 416, and a strengthening member 418 integrally associated with arm 414. Base 412 is bonded or otherwise securely affixed to side wall 398 such that blunt end 416 is tightly juxtaposed surface 406 when pump housing 226 is inserted and locked into place for use in cover 70 as seen in FIG. 17. So disposed, shafts 280 and 282 of pump 30 are aligned with inlet ports 316 and 314, respectively, of a cartridge 40 displaced into cover 70 for use.

When Pawl 400 is not under stress, arm 414 and blunt end 416 are offset from side wall 398 as seen in FIG. 17. Pawl 400 is made from synthetic resinous resilient material which permits blunt end 416 to be displaced against side wall 398 by a compressive force and which responsively returns to the unstressed offset position seen in FIG. 17 when the compressive force is removed.

Figure 18:
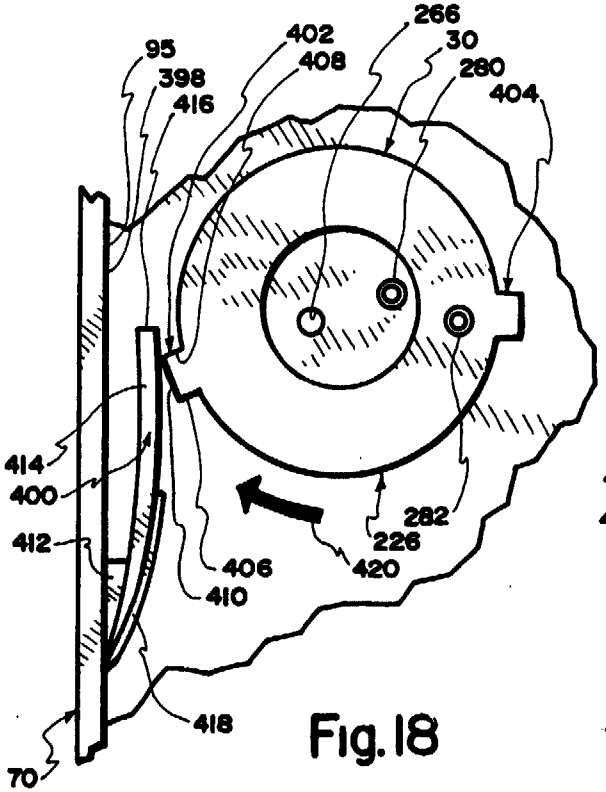
FIG. 18 is a top elevation of the pump of FIG. 17 being installed into the cover.

Pump housing 226 is engaged into cover 70, as earlier described, by disposing pump housing 226 upon retaining ring 190 such that tabs 242, 244 and 246 engage and communicate through respective slots 200, 202, and 204. (See FIGS. 6 and 16.) Pump housing 226 is rotated in the direction of arrow 420, seen in FIG. 18 and rotated against stop 218. When pump housing 226 is against stop 218, member 402 which has been forcing arm 414 toward side wall 398 disengages from arm 414 permitting arm 414 to resiliently move away from side wall 398 and lock pump housing 226 in place as seen in FIG. 17.

Figure 19:
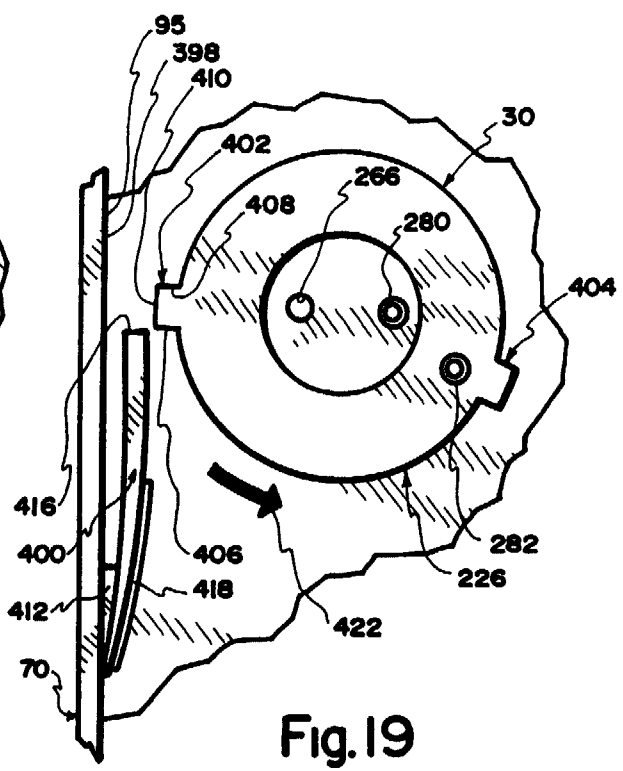
FIG. 19 is a top elevation of the pump of FIG. 17 with a pawl displaced from contact with the pump to permit removal of the pump.

To release and remove pump housing 226 from cover 70, arm 414 is displaced using a thumb or finger or extension thereof toward side wall 398 a sufficient distance for member 402 to clear blunt end 416 and associated end of arm 414 as seen in FIG. 19. Pump housing 226 is rotated in the direction of arrow 422 until tabs 242, 244 and 246 disengage from respective slots 200, 202, and 204. Pump housing is then facilely removed from cover 70.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method for using a foam dispenser comprising a disposable foam cartridge comprising the steps of:

(a) providing a housing, at least one foam dispensing cartridge comprising frangibly openable inlet ports and a sealed outlet port, and a one-way pump comprising inlet port franging hollow shafts disposed for concurrent frangible entry into said frangibly openable inlet ports;

(b) if any spent dispensing cartridge is in the housing, separating the one-way pump from said spent cartridge and removing the spent dispensing cartridges from said housing;

(c) placing a previously unused cartridge in said housing;

(d) frangibly inserting the one-way pump franging hollow shafts into said frangibly openable inlet ports (e) opening the seal on the outlet port;

(f) actuating the one-way pump to dispense foam through the outlet port;

(g) repeating step (f) until the cartridge is empty, then repeating steps (b) through (g).

2. A method for maintaining a biological agent growth-limiting and cross contamination free environment while providing a medically antiseptic foam from a foam dispensing assembly comprising the steps of:

(a) providing a housing having a replaceable manually operable pump means, a means for mounting the housing to a substantially vertical wall in a predetermined orientation and container covering means;

(b) providing at least one unused disposable sealed foamable-liquid transport and foaming container;

(c) opening the container covering means of said housing;

(d) removing any spent container from said container covering means, thereby removing all contaminated liquid reservoirs including liquid contained in foam creating sites within the spent container and thereby separating parts of the pump means which frangibly communicated pressurized and other gas to the spent container;

(e) observing the franging parts of the pump means for contamination;

(f) if the franging parts are contaminated, replacing the replaceable pump means;

(g) placing an unused disposable container into said container covering means;

(h) using franging parts of the pump means, frangibly breaking the seal of the container thereby providing at least one gas communicating pathway between the pump means and the container;

(i) closing said container covering means;

(j) removing all other seals from the container such as a plug from a foamed liquid dispensing spout associated with said container;

(k) manually operating said pump to dispense foam from said container;

(l) if no foam is dispensed during the operating step, returning to step (c);

(m) returning to step (k).

3. A method according to claim 2, comprising the additional steps of observing the fill level of the container;

if the fill level shows the container to be spent, returning to step (c).

4. A method of using a disposable foamer cartridge comprising the steps of:

providing a sealed disposable foamer cartridge comprising a relatively large internal storage chamber of foamable liquid, a relatively small internal pump chamber, a foam creating site and passages for air, foamable liquid and foam;

placing and retaining the disposable foamer cartridge in a holder;

equipping the holder with a manual air pump;

causing a seal to be broken so that atmospheric pressure is imposed upon the foamable liquid in the large storage chamber and selectively pressurized air from the pump is imposed upon a relatively small quantity of foamable liquid in the pump chamber whereby effluent loam comes into being at the foaming site.

5. A method according to claim 4 wherein the placing and retaining step positions the disposable cartridge in a selectively operable wall mounted holder.

6. A method according to claim 4 wherein the causing step comprises penetrating of at least one frangible wall of the cartridge.

7. A method according to claim 4 wherein the penetrating step comprises driving a rigid part of the pump through a frangible wall.

8. A method by which foam is created and discharged from an initially sealed disposable foamer cartridge comprising the steps of:

providing the initially sealed disposable foamer cartridge with a quantity of foamable liquid within a relatively large hollow region disposed between a tray and a sheet covering adhered to one side of the tray;

placing the disposable foamer cartridge in a wall mounted holder;

removably connecting a manual air pump carried by the holder to the foamer cartridge by puncturing the sealed foamer cartridge thereof to admit air at atmospheric pressure to the large hollow region and air from the air pump selectively to a relatively small pump chamber, charged periodically from the large hollow region, and to a foaming site to displace and foam foamable liquid.

9. A method by which foam is created from foamable liquid and discharged from a foamer cartridge comprising the steps of:

placing the foamable liquid within a relatively large reservoir of the foamer cartridge so that foamable liquid in the large reservoir is contiguous with a thin impervious membrane forming one side of the foamer cartridge;

charging a relatively small pump chamber with a small quantity of foamable liquid from the large reservoir so that foamable liquid in the small pump chamber is contiguous with the thin impervious membrane;

displacing air under pressure from a manual air pump contiguously along a thin impervious membrane to a foaming site and to the small pump chamber;

displacing foamable liquid from the small pump chamber contiguously along the thin impervious membrane to the foaming site;

co-mingling said air under pressure and said delivered foamable liquid at the foaming site to create a flow of foam;

displacing the foam contiguously along the thin membrane and discharging the foam from the foamer cartridge.

10. A method of foam production comprising the steps of:

placing a sealed foamer in a holder;

breaking a foamer seal to supply air to the interior of the foamer, to accommodate creation of foam from air and foamable liquid and to accommodate discharge of foam;

connecting a manual air pump directly to an air influent site of the foamer;

combining foamable liquid and pressurized air in the foamer to create foam;

discharging the foam from the foamer.

11. A method of foam production comprising the steps of:

breaking a foamer seal to supply air to an interior of the foamer, to accommodate creation of foam from air and foamable liquid and to accommodate discharge of foam;

connecting a manual air pump directly to an air influent site of the foamer;

displacing pressurized air and foamable liquid within the foamer, at least some of which displacement is contiguous with an impervious film at one side of the foamer so as to combine the air and foamable liquid to create foam;

displacing the foam along a predetermined path within the foamer, at least part of which is contiguous with the film, to a discharge location.

12. A method for installing a manual air pump and a disposable foamable-liquid containing and foaming cartridge in a holder for use as a foam producing assembly comprising the steps of:

(a) unlatching and rotating the holder to an open orientation whereat access is provided for installing the cartridge and air pump;

(b) inserting the air pump into the holder in an orientation keyed by complementary fittings on the holder the air pump;

(c) twisting the air pump in a first direction relative to the holder and thereat locking the air pump in place with pawl means to assure precise pump orientation relative to the holder;

(d) displacing the container into the holder in a predetermined container orientation relative to the holder;

(e) forcing the cartridge against the air pump such that puncturing means disposed on the air pump puncture frangible barriers on the container to break a seal on the container and open air transporting communication between the pump and the container;

(f) counter-rotating the holder to a closed and latched position for use.

13. A method according to claim 12 comprising the additional steps of:

(g) unlatching and rotating the holder to an open orientation whereat access is provided to the cartridge from which the foamable liquid has been expended and to the pump used to expend the foamable liquid.

(h) removing the liquid expended cartridge;

(i) inspecting the puncturing means for contamination;

(j) if the puncturing means are found to be contaminated, manually releasing the pawl means;

(k) twisting the air pump in a second direction relative to the holder and thereby removing the air pump from the holder;

(l) inserting an uncontaminated air pump into the holder in the orientation keyed by complementary fittings on the holder the air pump;

(m) twisting the air pump in the first direction relative to the holder and thereat locking the air pump in place with pawl means again assuring precise pump orientation relative to the holder;

(n) displacing a fresh foamable liquid container into the holder in the predetermined container orientation;

(o) forcing the fresh cartridge against the air pump such that puncturing means disposed on the air pump puncture frangible barriers on the container to break a seal on the container and open air transporting communication between the pump and the container;

(p) counter-rotating the holder to the closed and latched position for use.

14. A method for installing a manual air pump in a holder for use as a part of a liquid storage and controlled emission assembly comprising the steps of:

(a) providing an air pump comprising means for puncturing and for communicating air to sealed, frangibly openable liquid storage device ports disposed for puncturing and communicating at predetermined sites and means for engaging pawl means in a predetermined orientation relative to said puncturing and communicating means;

(b) providing an empty holder for said pump comprising means for spatially orienting said pump relative to said predetermined sites and pawl means for securing said pawl engaging means such that the puncturing and communicating means are disposed for alignment with said frangibly openable ports;

(c) inserting the air pump into the holder in an orientation keyed by complementary fittings between the air pump and holder;

(d) twisting the air pump until the pawl means lock against the pawl engaging means to securely hold the air pump in said predetermined orientation.

* * * * *